US007955026B2

(12) United States Patent
Kamiyama et al.

(10) Patent No.: US 7,955,026 B2
(45) Date of Patent: Jun. 7, 2011

(54) METHOD FOR REHABILITATING A MANHOLE

(75) Inventors: Takao Kamiyama, Hiratsuka (JP); Koji Kaneta, Hiratsuka (JP); Kenji Fujii, Hiratsuka (JP); Katsuyori Miura, Hiratsuka (JP)

(73) Assignee: Shonan Gosei-Jushi Seisakusho K.K. (JP)

( * ) Notice: Subject to any disclaimer, the term of this patent is extended or adjusted under 35 U.S.C. 154(b) by 136 days.

(21) Appl. No.: 12/459,985

(22) Filed: Jul. 10, 2009

(65) Prior Publication Data

US 2010/0008729 A1 Jan. 14, 2010

(30) Foreign Application Priority Data

Jul. 11, 2008 (JP) ..... 2008-180904
Jan. 21, 2009 (JP) ..... 2009-010473

(51) Int. Cl.
*E02D 29/12* (2006.01)

(52) U.S. Cl. ..... 405/55; 405/303; 405/133; 405/184.1; 405/184.2; 52/20; 52/21

(58) Field of Classification Search ..... 405/52, 405/53, 55, 133, 184.1, 184.2, 303; 52/19, 52/20, 21
See application file for complete search history.

(56) References Cited

U.S. PATENT DOCUMENTS 5,002,438 A * 3/1991 Strong ..... 405/303
5,265,981 A * 11/1993 McNeil ..... 405/303
5,271,193 A * 12/1993 Olsen et al. ..... 52/19
5,303,518 A * 4/1994 Strickland ..... 52/21
5,383,311 A * 1/1995 Strickland ..... 52/20
5,415,499 A * 5/1995 Hyde-Smith et al. ..... 405/303
5,752,787 A * 5/1998 Trangsrud ..... 52/20
6,018,914 A * 2/2000 Kamiyama et al. ..... 52/20
6,161,985 A * 12/2000 Hinkle et al. ..... 52/20
6,226,928 B1 * 5/2001 Trangsrud ..... 52/20
6,368,025 B1 * 4/2002 McNeil ..... 405/303
2005/0238437 A1 * 10/2005 Kamiyama et al. ..... 405/184.1
2007/0028541 A1 * 2/2007 Pasek ..... 52/250

FOREIGN PATENT DOCUMENTS

JP 05059739 A * 3/1993

* cited by examiner

*Primary Examiner* — Frederick L Lagman
(74) *Attorney, Agent, or Firm* — Adams & Wilks

(57) ABSTRACT

To line an inner circumferential surface of side walls of a manhole, a rehabilitating sheet made of a sheet material resistant to water and corrosion is provided in the form of a bag having a shape corresponding to the inner circumferential surface to be lined. The rehabilitating sheet is inserted into the manhole to be lined. Block and plate frames are coupled inside the bag of the rehabilitating sheet to support it so as to have the shape corresponding to the inner circumferential surface to be lined. A gap between the rehabilitating sheet and the inner circumferential surface of the side walls of the manhole is filled with a filler, which is then hardened to line the side walls of the manhole. Pairs of plate frames having different diameters are coupled to each other to provide ring plates having different diameters. The ring plates are stacked one by one from the maximum one to support the rehabilitating sheet so as to have a shape of the inner circumferential surface of the inclined side wall portion of the manhole.

11 Claims, 21 Drawing Sheets

METHOD FOR REHABILITATING A MANHOLE

BACKGROUND OF THE INVENTION

1. Field of the Invention

The present invention relates to a method for rehabilitating a manhole, in particular to a method for rehabilitating a corroded or damaged existing manhole by reinforcing an inner circumference of a sidewall of the manhole.

2. Description of the Prior Art

The following two typical methods are known to rehabilitate a manhole.

A first method for rehabilitating a manhole is disclosed in Japanese Patent Laid Open Publication No. 1996-150659. This method uses a lining material consisting of a flexible resin absorbing material which has a cylindrical bag shape corresponding to a shape of the inner circumferential surface of the manhole and which is impregnated with a liquid thermosetting resin. The lining material is folded for insertion into the manhole, and pressed from the inside thereof against the inner circumferential surface of the manhole by the pressure of water. The lining material is then heated using a hot water shower, so that the liquid thermosetting resin impregnated therein is cured to provide a rehabilitating pipe for the manhole.

A second method for rehabilitating a manhole is disclosed in Japanese Patent Laid Open Publication No. 2005-307577, in which a pipe-shaped body is assembled in the manhole to provide a rehabilitating pipe whose outer diameter is slightly smaller than an inner diameter of the manhole and whose inner circumferential surface constitutes a cylindrical. surface. For this purpose, the method uses a plurality of segments each of which is integrally molded of plastics and has a shape obtained when the rehabilitating pipe is divided respectively into a plurality of parts in the circumferential direction and the vertical direction (pipe longitudinal direction). A plurality of segments thus formed is successively inserted into the manhole, then coupled in the circumferential direction and stacked in the vertical direction, thereby assembling the rehabilitating pipe. Thereafter, a gap between the manhole and the rehabilitating pipe is filled with a filler. The filler is then hardened to integrate the rehabilitating pipe and the manhole, thus providing a compound pipe.

However, in the first method, the lining material inserted into the manhole is subjected to flooding, showering by hot water, and draining of the hot water. This requires large-scaled and expensive instruments or equipments such as boilers, tanks, pumps, various kinds of hoses, and the like. The first method is thus disadvantageous in cost. Further, the first method requires that a boiler car equipped with the boiler parks on a road in the construction site. Consequently, the boiler car, or the like inevitably occupies a large area on the road, thereby giving a large influence on the traffic.

The second method is also disadvantageous in cost because the segments are required for constructing the rehabilitating pipe. Namely, in order to reduce the cost of the segments each of which is integrally formed of plastic, it is necessary to mass-produce a single kind of the segments having the same shape and size. On the other hand, a large number of the segments are not needed for rehabilitating a manhole. In addition, the rehabilitating pipe cannot be constructed from the single kind of the segments because it depends upon the shape of the inner circumferential surface of the manhole. For example, the upper portion of the rehabilitating pipe has a hollow circular truncated cone form while the other lower portion has a hollow column form. In this case, the segments the same in shape and size can be used to assemble the lower portion of the rehabilitating pipe. On the other hand, the segments having different sizes from each other are needed to assemble the upper portion of the rehabilitating pipe that has the hollow circular truncated cone form, thus increasing the cost for producing the segments used for the upper portion of the hollow circular truncated cone form of the rehabilitating pipe.

SUMMARY OF THE INVENTION

It is therefore an object of the present invention to provide a method for rehabilitating a manhole capable of readily performing a construction of rehabilitating the manhole at a low cost without requiring large-scaled and expensive instruments and occupying a large area.

According to a first aspect of the present invention, there is provided a method for rehabilitating a manhole which rehabilitates the manhole by lining side walls thereof having a side wall of a hollow circular truncated cone form and a side wall of a hollow column form, said method comprising the steps of:

preparing a rehabilitating sheet which has a shape corresponding to a shape of the whole inner circumferential surface of said side walls of a manhole to be rehabilitated;

providing a frame assembly which supports said rehabilitating sheet so as to have a shape corresponding to the shape of the inner circumferential surface of said side walls of said manhole after inserting said rehabilitating sheet into said manhole; and filling a gap between said inner circumferential surface of said side walls of said manhole and said rehabilitating sheet with a filler to line the inner circumferential surface of said side walls of said manhole by the rehabilitating sheet;

wherein ring plates having respective diameters different from each other and corresponding to respective portions of the side wall of the hollow circular truncated cone form are prepared, and the ring plates of a smaller diameter are successively stacked in the vertical direction on the ring plates of a larger diameter, thereby supporting said rehabilitating sheet so as to have a shape corresponding to the shape of the inner circumferential surface of the side wall of the hollow circular truncated cone form.

In the method for rehabilitating a manhole according to the first aspect of the present invention, large-scaled and expensive instruments are not required. Further, since a large area is not occupied on a road in the construction site, there is no large influence on the traffic. In addition, the rehabilitating sheet can be formed at a low cost by readily processing a cheap sheet material.

Moreover, the frames used for the side wall of the hollow circular truncated cone form of the manhole are constituted by the ring plates having respective diameters different from each other and corresponding to respective portions of the side wall of the hollow circular truncated cone form. Further, the ring plates are successively stacked in the vertical direction by stacking a ring plate having a diameter on an underlying ring plate having another diameter larger than said diameter, so that the rehabilitating sheet can be supported so as to have a shape corresponding to the shape of the inner circumferential surface of the side wall of the hollow circular truncated cone form. The rehabilitating sheet can be readily expanded so as to have a shape corresponding to the shape of the hollow circular truncated cone form of the manhole.

Further, since the ring plate is assembled by coupling a plurality of segments, the ring plates having various diameters can be readily assembled inside the manhole only by making each segment have a size capable of being inserted into the manhole from the inlet thereof.

Moreover, after completion of the lining, the segments and the ring plates can be removed from the manhole by disassembling the frame assembly into such segments and ring plates. Thereafter, the segments and the ring plates can be used again in another construction of rehabilitating a manhole. Therefore, the costs can be further reduced.

According to a second aspect of the present invention, there is also provided a method for rehabilitating a manhole which rehabilitates the manhole by lining side walls thereof having a side wall of a hollow circular truncated cone form and an underlying side wall of a hollow column form, said method comprising the steps of:

preparing a rehabilitating sheet which has a shape corresponding to a shape of the inner circumferential surface of said side wall of said hollow circular truncated cone form of a manhole to be rehabilitated;

successively coupling a plurality of segments inside the underlying side wall of said hollow column form of said manhole, thereby assembling a rehabilitating pipe having a hollow column form whose outer diameter is smaller than an inner diameter of said underlying side wall of said hollow column form of said manhole and whose inner circumferential surface is constituted by the successively coupled segments;

filling a gap between said inner circumferential surface of said underlying side wall of said hollow column form of said manhole and said rehabilitating pipe with a filler to line the inner circumferential surface of said underlying side wall of said hollow column form of said manhole by the rehabilitating pipe;

inserting said rehabilitating sheet into said manhole and adhering a lower end portion of said rehabilitating sheet on an inner circumferential surface of an upper end portion of said rehabilitating pipe, thereafter providing a frame assembly which supports said rehabilitating sheet so as to have a shape corresponding to the shape of an inner circumferential surface of said side wall of the hollow circular truncated cone form; and filling a gap between said inner circumferential surface of said side wall of the hollow circular truncated cone form of said manhole and said rehabilitating sheet with a filler to line the inner circumferential surface of said side wall of the hollow circular truncated cone form of said manhole by the rehabilitating sheet;

wherein ring plates having respective diameters different from each other and corresponding to respective portions of the side wall of the hollow circular truncated cone form are prepared, and the ring plates of a smaller diameter are successively stacked in the vertical direction on the ring plates of a larger diameter, thereby supporting said rehabilitating sheet so as to have a shape corresponding to the shape of the inner circumferential surface of the side wall of the hollow circular truncated cone form.

In the method for rehabilitating a manhole according to the second aspect of the present invention, it is possible to line the inner circumferential surface of the underlying side wall of the hollow column form of the manhole more strongly by the rehabilitating pipe. Since the rehabilitating pipe having a shape of the hollow column form can be assembled only by a single kind of the segments, it doesn't cost so much.

According to a third aspect of the present invention, there is further provided a method for rehabilitating a manhole which rehabilitates the manhole by lining side walls thereof having a side wall of a hollow circular truncated cone form and a side wall of a hollow column form, said method comprising the steps of:

successively coupling a plurality of segments inside the side wall of said hollow column form of a manhole to be rehabilitated, thereby assembling a rehabilitating pipe having a hollow column form whose outer diameter is smaller than an inner diameter of said side wall of said hollow column form of said manhole and whose inner circumferential surface is constituted by the successively coupled segments;

filling a gap between said inner circumferential surface of said side wall of said hollow column form of said manhole and said rehabilitating pipe with a filler to line the inner circumferential surface of said side wall of said hollow column form of said manhole by the rehabilitating pipe;

preparing a rehabilitating sheet which has a shape corresponding not only to a shape of the inner circumferential surface of said side wall of said hollow circular truncated cone form of said manhole but also to a shape of the inner circumferential surface of said rehabilitating pipe;

inserting said rehabilitating sheet into said manhole, thereafter providing a frame assembly which supports said rehabilitating sheet so as to have a shape corresponding not only to the shape of the inner circumferential surface of said side wall of said hollow circular truncated cone form of said manhole but also to the shape of the inner circumferential surface of said rehabilitating pipe; and filling a gap between said inner circumferential surface of said side wall of the hollow circular truncated cone form of said manhole as well as the inner circumferential surface of said rehabilitating pipe and said rehabilitating sheet with a filler to line the inner circumferential surface of said side wall of the hollow circular truncated cone form of said manhole and the inner circumferential surface of said rehabilitating pipe by the rehabilitating sheet;

wherein ring plates having respective diameters different from each other and corresponding to respective portions of the side wall of the hollow circular truncated cone form are prepared, and the ring plates of a smaller diameter are successively stacked in the vertical direction on the ring plates of a larger diameter, thereby supporting said rehabilitating sheet so as to have a shape corresponding to the shape of the inner circumferential surface of the side wall of the hollow circular truncated cone form.

In the method for rehabilitating a manhole according to the third aspect of the present invention, the inner circumferential surface of the underlying side wall of the hollow column form of the manhole is lined twice by the rehabilitating pipe and the rehabilitating sheet. Consequently, the lining can be performed more strongly, although it costs more, compared with the method for rehabilitating a manhole according to the above-mentioned second aspect of the present invention.

DESCRIPTION OF THE PREFERRED EMBODIMENTS

The present invention will be described based on preferred embodiments, referring to the attached drawings.

Figure 13:
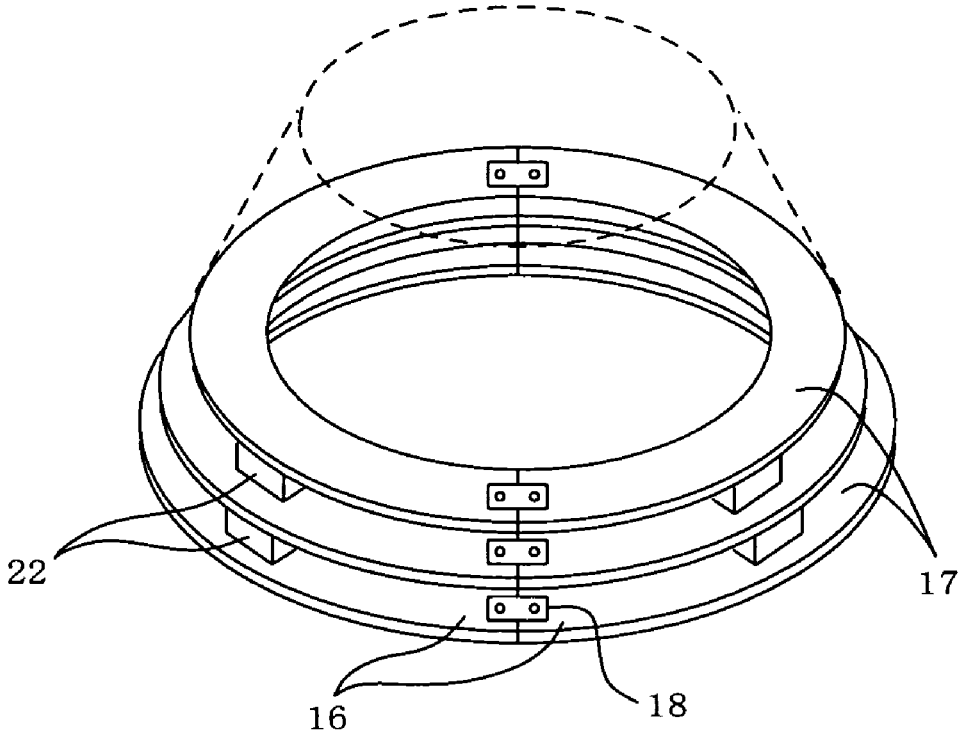
FIG. 13 is a perspective view for showing a condition that plate frames for the inclined wall are being coupled.
Figure 14:
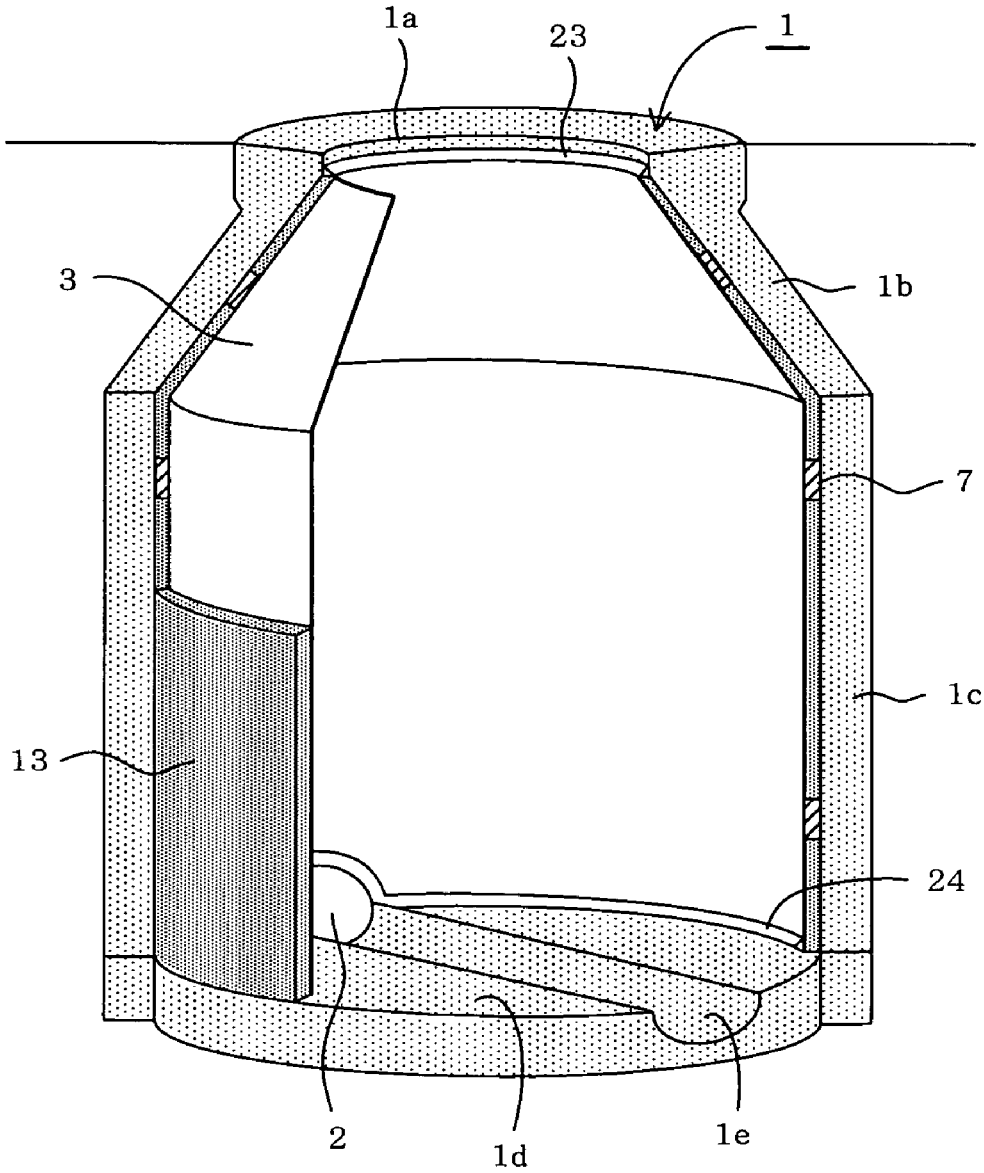
FIG. 14 is a partially broken, perspective view for showing a condition that a construction for rehabilitating the manhole has been completed.

Now, referring to FIGS. 1 through 14, description is made about a first embodiment of the present invention. FIG. 14 shows a condition that a construction by a method for rehabilitating a manhole according to this embodiment has been completed. As illustrated in FIG. 14, a manhole 1 to be rehabilitated in this embodiment is formed to be cylindrical in shape having an opening 1*a* at the upper end thereof. The manhole 1 has a cylindrical side wall whose upper portion constitutes a side wall of a hollow circular truncated cone form and whose lower portion constitutes a side wall of a hollow column form having a constant diameter. The side wall of the upper portion of the hollow circular truncated cone form is referred to as an inclined wall portion 1*b* while the side wall of the other lower portion of the hollow column form referred to as a straight wall portion 1*c*. The entire side wall is designated by reference numerals 1*b*, 1*c*. Furthermore, a groove 1*e* having a semi-circular cross-section is formed in a circular bottom portion 1*d* of the manhole 1. The groove 1*e* is connected to a lower half portion of a circular opening of a pipe 2 constituting a sewage pipe which crosses the manhole 1.

In the construction for rehabilitating the manhole 1 in this embodiment, a lining having a constant thickness is formed to cover all the inner circumferential surface of the side walls 1*b*, 1*c* of the manhole 1. The lining comprises a rehabilitating sheet 3 and a filler 13. The rehabilitating sheet 3 forms an inner circumferential surface of the lining. A gap between the rehabilitating sheet 3 and the inner circumferential surface of the side walls 1*b*, 1*c* is filled with the filler 13. The filler 13 is fluidic but hardened over time, and is made, for example, of resin mortar or cement mortar.

The rehabilitating sheet 3 is formed in the form of a bag having a radius smaller by a thickness of the filler than that of the inner circumferential surface of the side walls 1*b*, 1*c*. The rehabilitating sheet 3 is made of a sheet material which is flexible, resistant to water and/or corrosion, and also strongly adhesive to the hardened filler (mortar) 13. The rehabilitating sheet 3 is made, for example, of a sheet material consisting only of high density polyethylene, or made of another sheet material having two layers of a base layer of high density polyethylene and a coating layer of acrylic resin formed thereon. Such a sheet material is Preprufe (Registered trademark) manufactured by Grace Construction Products, Co. Ltd. or the like.

Figure 1:
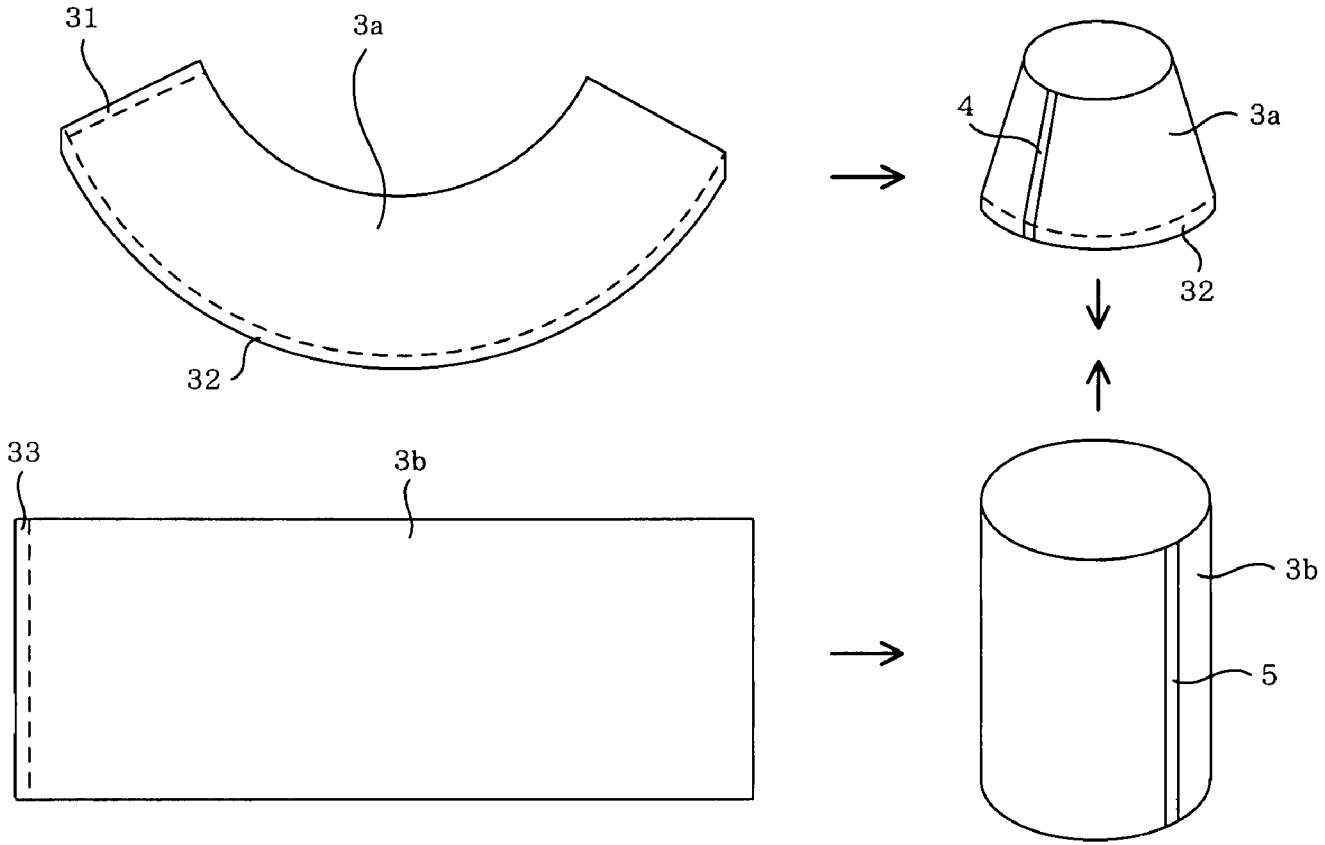
FIG. 1 is a view for explaining processes of forming a rehabilitating sheet in a method for rehabilitating a manhole according to a first embodiment of the present invention.
Figure 2:
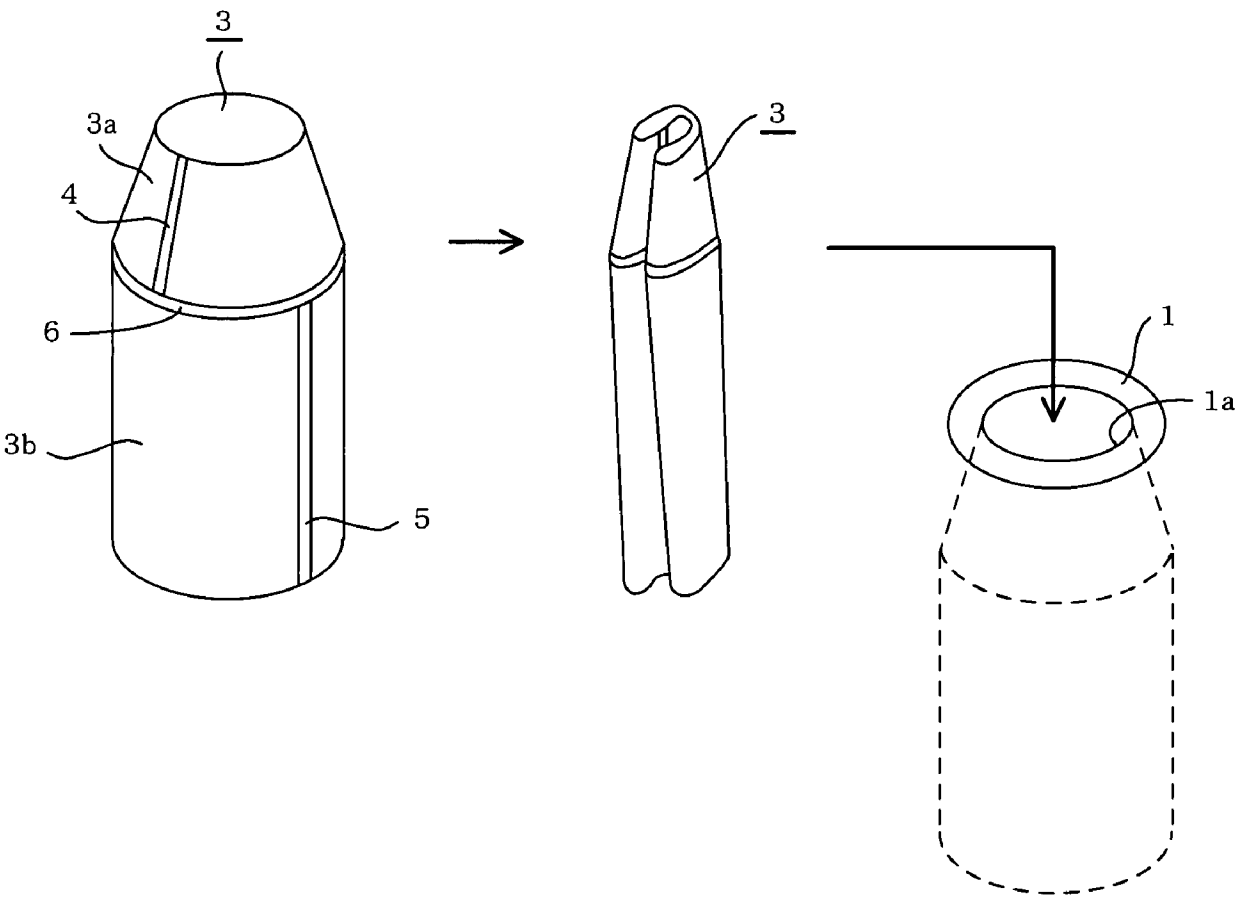
FIG. 2 is a view for showing the rehabilitating sheet, which is folded for insertion into a manhole.

In the processes of the construction for rehabilitating a manhole of this embodiment, at first, the rehabilitating sheet 3 is formed from the above-mentioned sheet material, as shown in FIGS. 1 and 2. Namely, a long and continuous sheet material is, at first, cut to produce sheets 3*a*, 3*b* as illustrated on a left side of FIG. 1. The sheet 3*a* has an arcuately curved belt shape to which marginal portions 31, 32 are added at the left and lower sides edge portions thereof. The shape of the sheet 3*a* corresponds to the developed shape of the inner circumferential surface of the inclined wall portion 1*b* of the manhole 1. On the other hand, the shape of the sheet 3*b* corresponds to the developed shape of the inner circumferential surface of the hollow column form of the straight wall portion 1*c* thereof with a margin 33 added to the left side edge portion.

Next, a double-stick tape (not shown) is put on the marginal portion 31 of the sheet 3*a*. The sheet 3*a* is then rounded and a right side edge portion of the sheet 3*a* in FIG. 1 is overlapped on the double-stick tape for adhesion thereon. Further, an adhesive tape 4 shown on the right side of FIG. 1 is attached on the overlapped portion of right and left side edges of the sheet 3*a*. The sheet 3*a* is thus formed to have a shape corresponding to the shape of the inclined wall portion 1*b* of the manhole 1.

Further, a double-stick tape (not shown) is put on the marginal portion 33 of the sheet 3*b*. The sheet 3*b* is then rounded and a right side edge portion of the sheet 3*b* in FIG. 1 is overlapped on the double-stick tape for adhesion thereon. Further, an adhesive tape 5 shown on the right side of FIG. 1 is adhered on the overlapped portion of right and left side edges of the sheet 3*b*. The sheet 3*b* is thus formed to have a shape corresponding to the shape of the straight wall portion 1*c* of the manhole 1.

Next, the marginal portion 32 of the lower edge of the sheet 3*a* is overlapped on the upper edge portion of the sheet 3*b*. Further, an adhesive tape 6 shown on the left side of FIG. 2 is attached to the overlapped portion of the lower and upper edges of the sheets 3*a* and 3*b*. The rehabilitating sheet 3 is thus formed as a bag whose shape corresponds to that of the inner wall of the manhole 1. The above-described processes of forming the rehabilitating sheet 3 can be implemented at the construction site for rehabilitating the manhole 1. However, it is preferable that the processes are previously completed in a factory.

Figure 8:
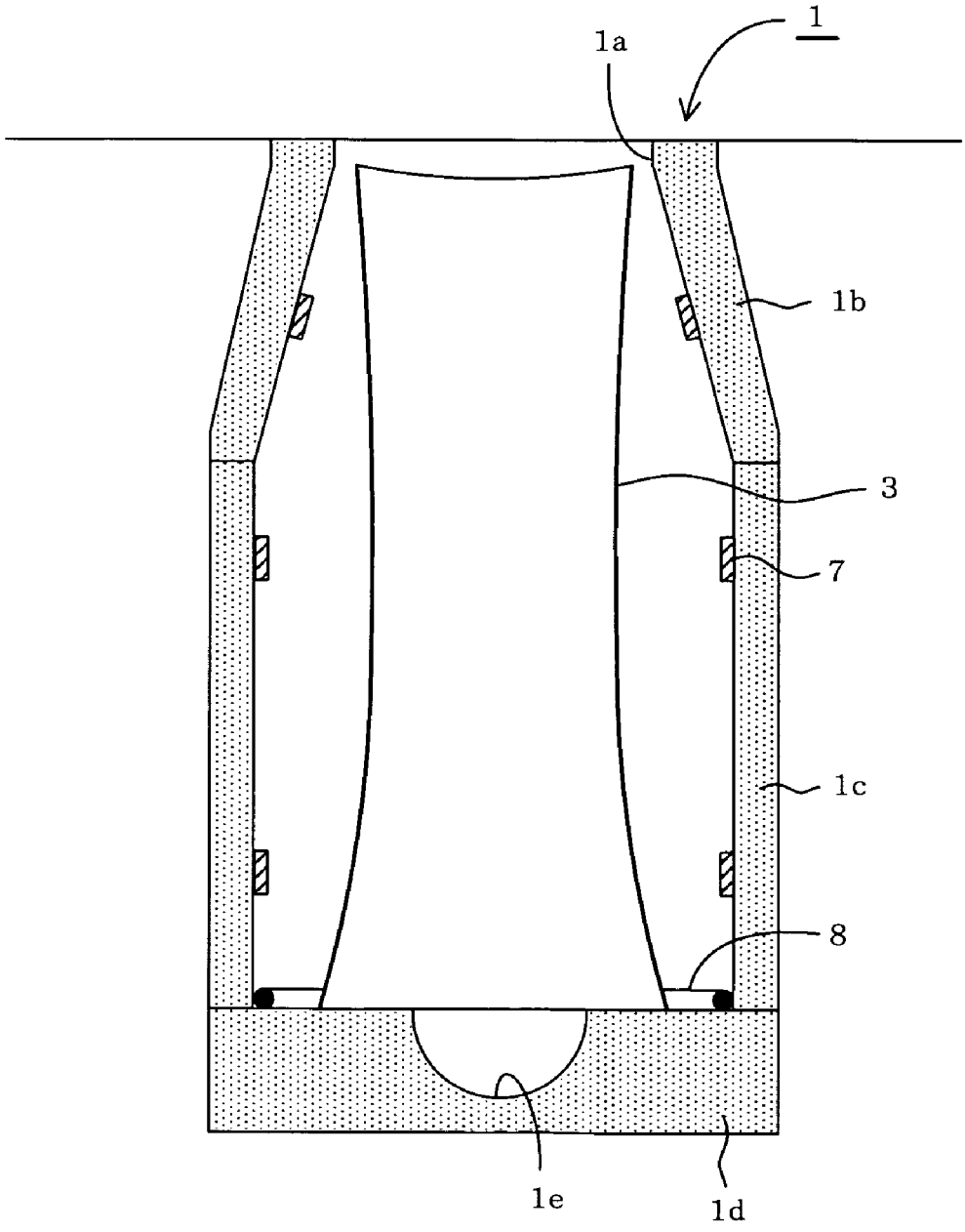
FIG. 8 is a cross-sectional view for showing a manhole in a condition that the rehabilitating sheet has been inserted into the manhole.

Next, at the construction site, the rehabilitating sheet 3 is folded so as to be slender, as illustrated in a center of FIG. 2, and then inserted into the manhole 1 through the opening 1*a* illustrated on a right side of FIG. 2. The rehabilitating sheet 3 thus inserted into the manhole 1 is shown in FIG. 8.

Figure 7:
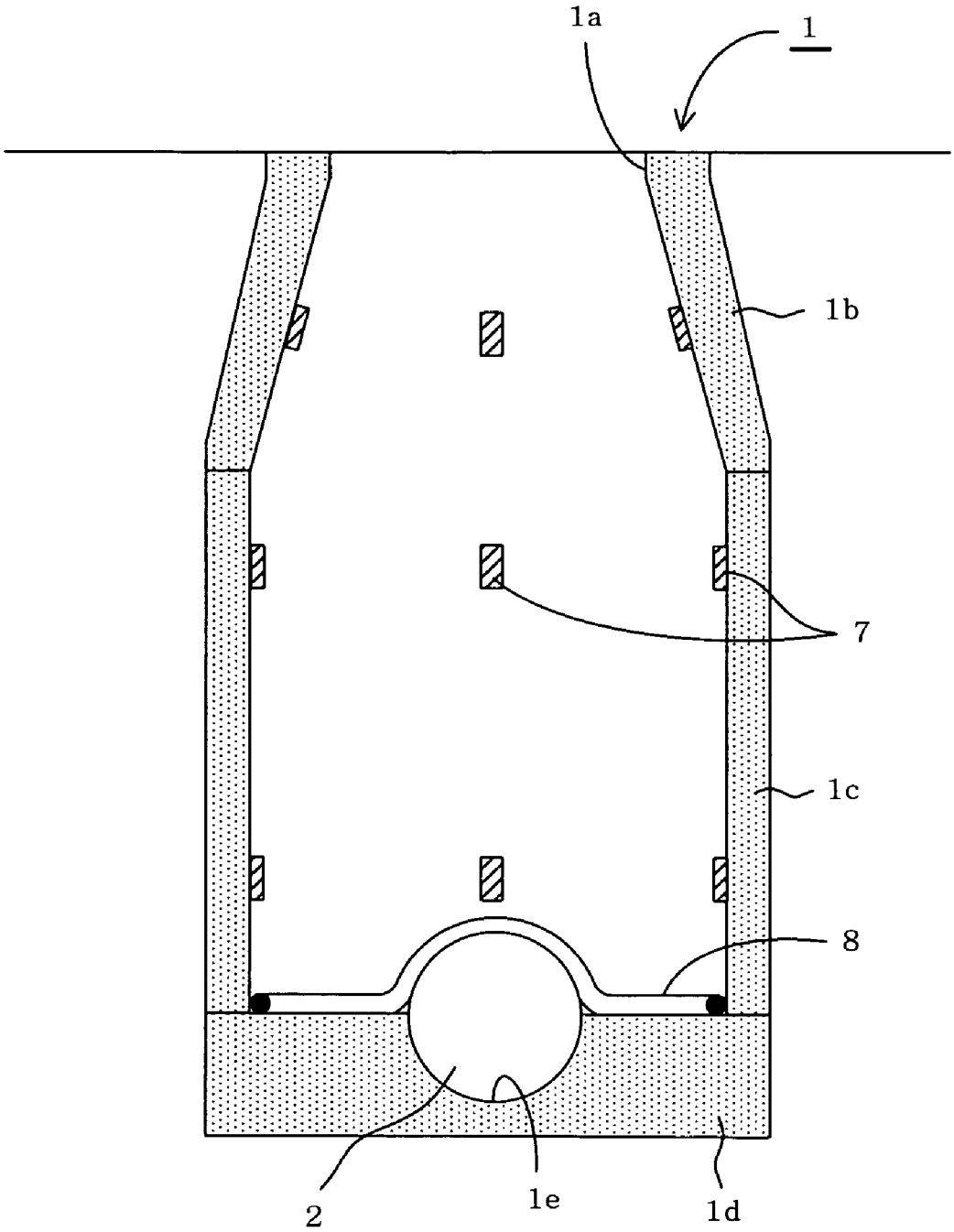
FIG. 7 is a cross-sectional view for showing a manhole in a condition that spacers and back-up materials have been attached before inserting the rehabilitating sheet into the manhole in the process of the first embodiment.

Prior to insertion of the rehabilitating sheet 3 into the manhole, a plurality of ring-shaped spacers 7 is fixed to the inner circumferential surface of the side walls 1*b*, 1*c* of the manhole 1 at a plurality of locations, as illustrated in FIG. 7. A gap of about several centimeters is provided using the ring-shaped spacers 7 between the inner circumferential surface of the side walls 1*b*, 1*c* and the rehabilitating sheet 3 and will later be filled with the filler 13. In addition, a string-shaped back-up member 8 is fixed using an adhesive inside the lower portion of the straight wall 1*c*. This not only serves to allow a gap to be filled with the filler 13 but also prevents the filler 13 from being flowed out of the lower end of the straight wall 1*c*. After the ring-shaped spacers 7 and the string-shaped back-up member 8 have thus been installed, the rehabilitating sheet 3 is inserted into the manhole 1, as shown in FIG. 8.

Next, an operator goes inside the rehabilitating sheet 3 in the manhole 1 to press the rehabilitating sheet 3 from the inside toward the inner circumferential surface of the manhole 1. The operator then stacks work frames successively to support the rehabilitating sheet 3. The work frames are stacked so that they may provide a shape corresponding to that of the side walls of the manhole 1.

Figure 5:
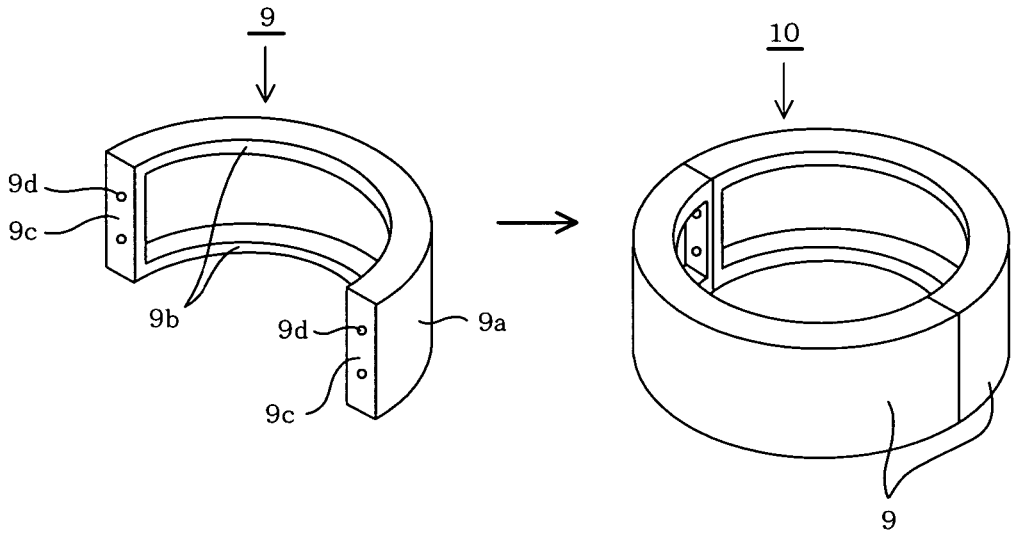
FIG. 5 is a perspective view for showing a block frame for a straight wall of the manhole as well as a short pipe coupled by a pair of the block frames.
Figure 6:
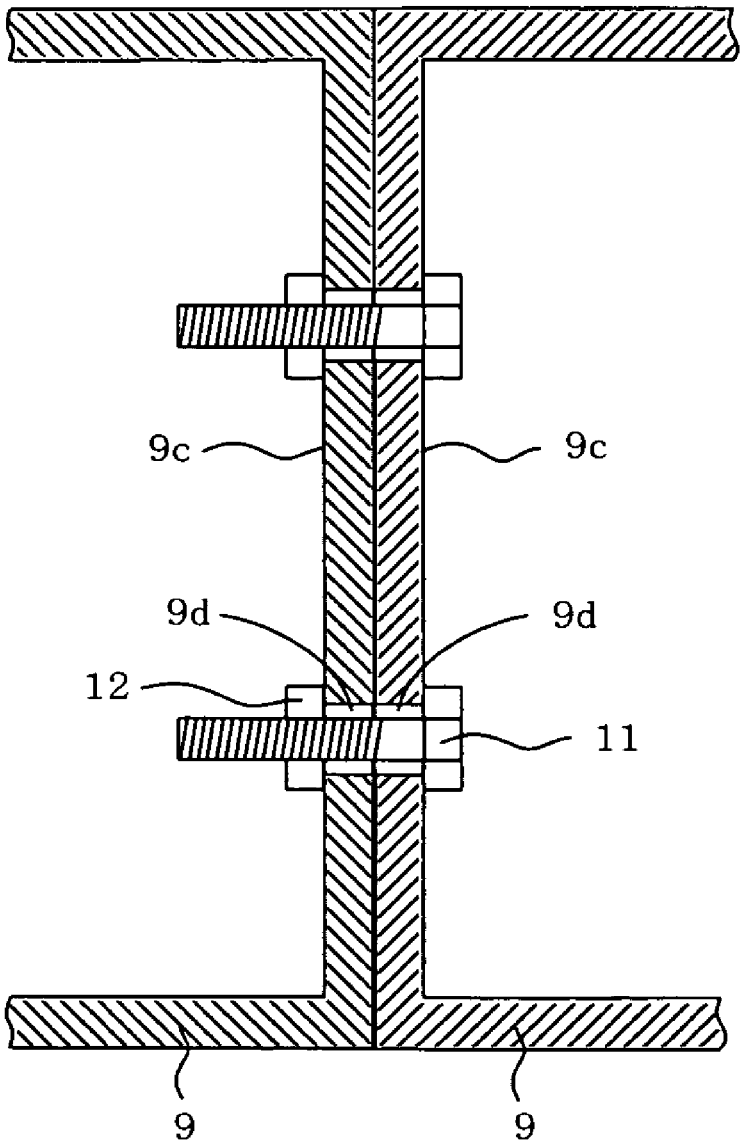
FIG. 6 is a cross-sectional view for showing how block frames are coupled to each other.
Figure 9:
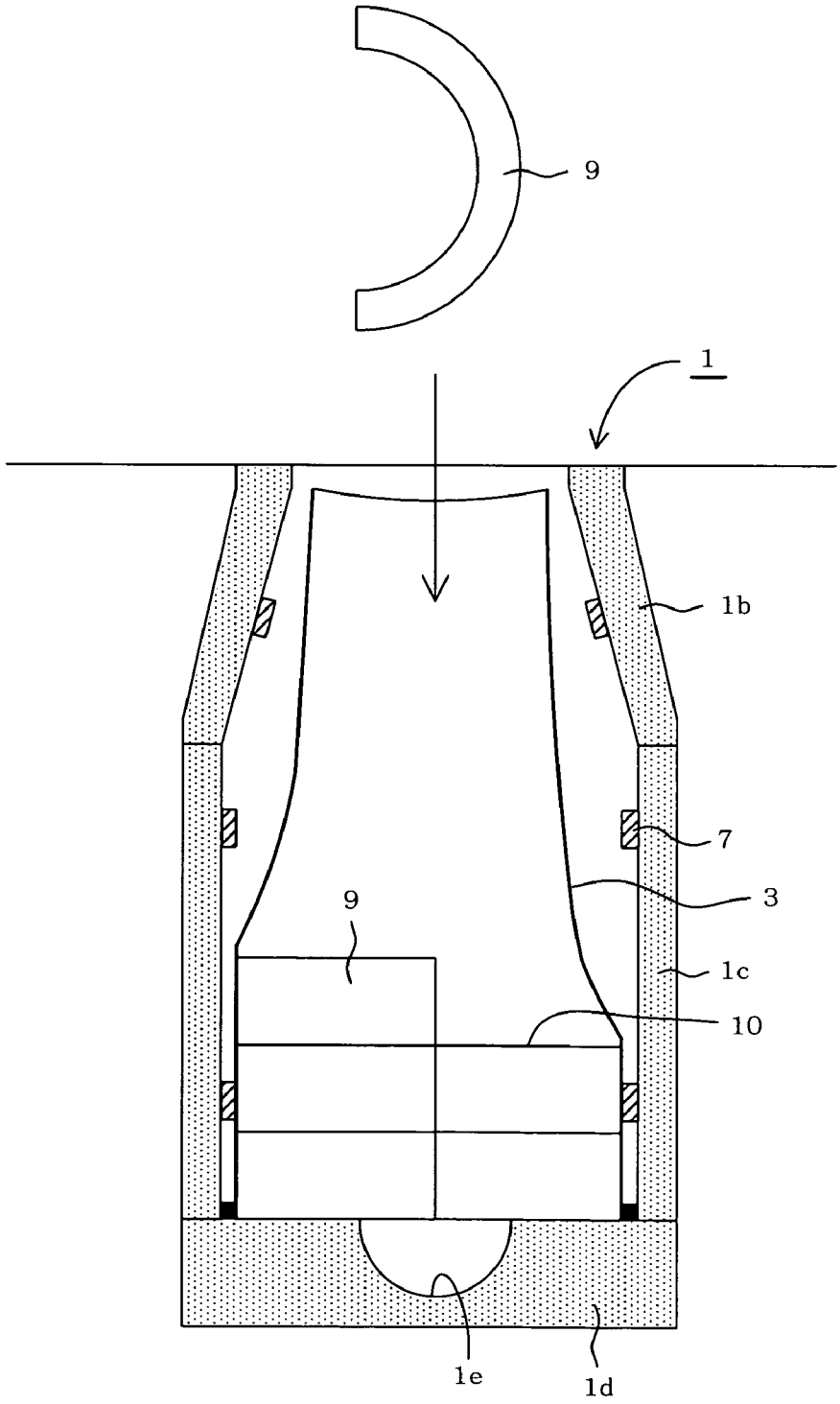
FIG. 9 is a cross-sectional view for showing a condition that block frames for the straight wall are being coupled inside a bag of the rehabilitating sheet.
Figure 10:
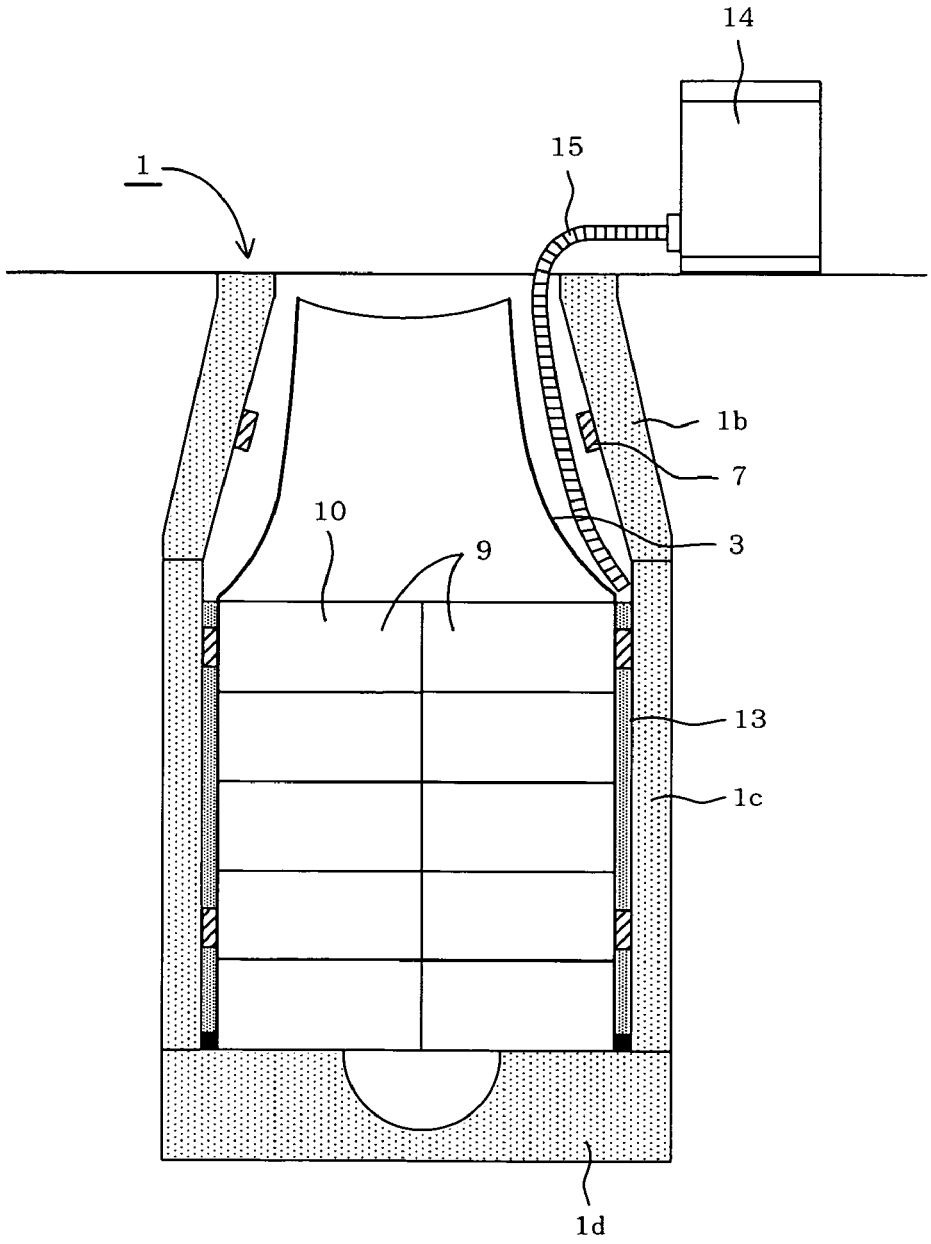
FIG. 10 is a cross-sectional view for showing a condition that a filler is being poured after coupling the block frames for the straight wall.

At first, a plurality of block frames 9 as shown in FIG. 5 is used to provide a frame assembly in the form of a hollow column, as shown in FIGS. 9 and 10. The block frame 9 comprises an outer circumferential plate 9*a*, upper and lower side plates 9*b*, and end plates 9*c*. These plates 9*a*, 9*b*, 9*c* are integrally molded from plastics, as illustrated on the left side of FIG. 5. The outer circumferential plate 9*a* forms an outer circumferential surface of the block frame 9 and curved in the shape of an arc. A diameter of the outer circumferential plate 9*a* is determined to be smaller than an inner diameter of the straight wall 1*c* by a sum of thicknesses of the rehabilitating sheet 3 and the ring-shaped spacer 7. Further, a height of the outer circumferential plate 9*a* is determined to be, for example, about several tens centimeters. The side plates 9*b* extend along the upper and lower edges of the outer circumferential plate 9*a*, respectively, and project inside therefrom by a predetermined size. The end plates 9*c* extend along both the end edges of the outer circumferential plate 9*a*, respectively, and project inside therefrom 9*a* by a predetermined size similarly to the side plates 9*b*. In this embodiment, the end plates 9*c* are provided respectively with two holes 9*d* for coupling a pair of the block frames 9 in the circumferential direction. A plurality of reinforcing ribs are formed on the inner circumferential surface of the outer circumferential plate 9*a* so as to extend along both the circumferential and vertical directions, although the reinforcing ribs are omitted for the simplicity of illustration.

Every time two block frames 9 have been inserted into the rehabilitating sheet 3, they are coupled as shown on the right side of FIG. 5 using bolts 11 and nuts 12 to provide a short frame pip 10. The short frame pipe 10 has a continuous outer circumferential surface formed by the two outer circumferential plates 9*a*.

The operator then stacks the short frame pipes 10 one by one on the bottom portion 1*d* of the manhole 1, as shown in FIGS. 9 and 10. At this time, the rehabilitating sheet 3 can be expanded and supported so as to have a cylindrical shape corresponding to the outer circumferential surfaces of the short frame pipes 10 by pressing the outer circumferential surfaces of the short frame pipes 10 toward the inner surface of the bag of the rehabilitating sheet 3 and keeping the position of the short frame pipes 10 horizontally.

Alternatively, a gap between the end plates 9*c* of the short frame pipe 10 can be adjusted so as to be wider. For this purpose, a spacer is interposed between the end plates 9*c*. Alternatively, the gap between the end plates 9*c* can be adjusted by adjusting the screwing of the bolt into the nut. Thus, the outer circumferential surfaces of the short frame pipes 10 are pressed against the rehabilitating sheet 3 by expanding the gap between the end plates 9*c* of the short frame pipes 10, thereby supporting the rehabilitating sheet 3 in a sufficiently expanded state.

The short frame pipes 10 are stacked one by one up to a height near the upper end of the straight wall 1*c* of the manhole 1, as shown in FIG. 10, thereby providing a frame assembly having the shape of the hollow column corresponding to the straight wall 1*c* of the manhole 1. This also allows the rehabilitating sheet 3 to be expanded and supported with the shape of the hollow column.

Next, as shown in FIG. 10, the gap between the rehabilitating sheet 3 supported by the frame assembly and the inner circumferential surface of the straight wall 1*c* is filled with a filler 13. For this purpose, a container 14 containing the filler 13 is disposed on the ground near the manhole 1, and the filler 13 is poured from the container 14 via a hose 15 through the gap between the upper end portion of the straight wall 1*c* and the rehabilitating sheet 3.

Alternatively, the filler 13 may be poured at once every time one or some short frame pipes 10 have been stacked. This prevents the filler 13 from being flowed out of the lower end portion. When the short frame pipes 10 are stacked at the lower end portion of the manhole, a filler is preferably used which is hardened for a short time.

Figure 3:
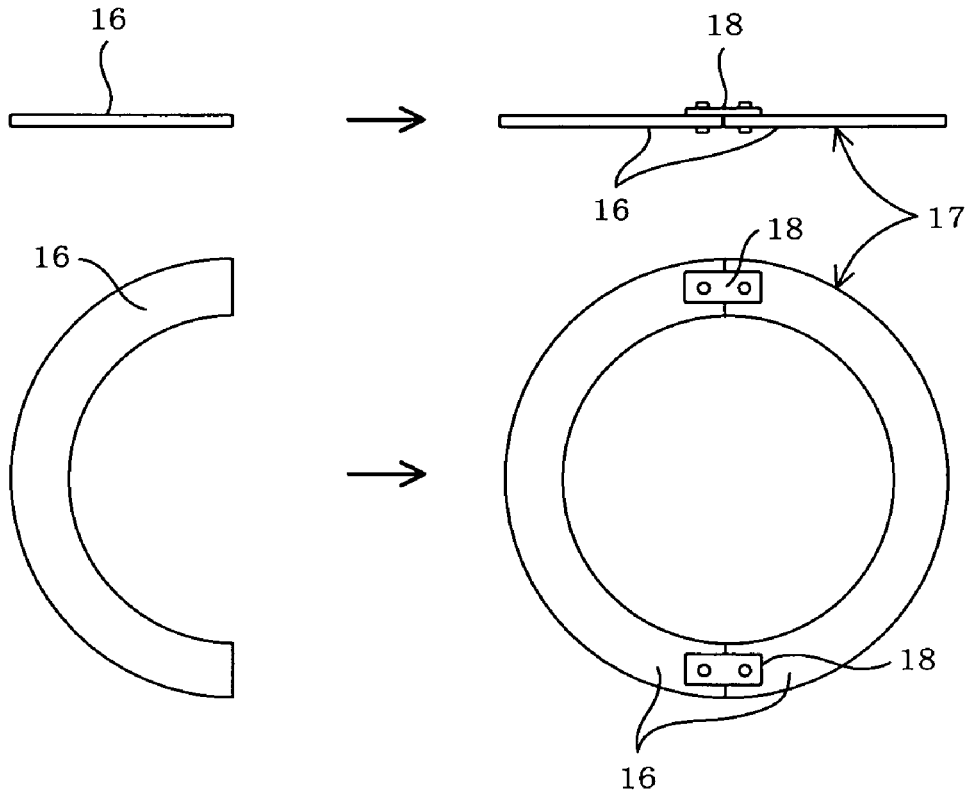
FIG. 3 is a view for showing a plate frame for an inclined wall of the manhole as well as a ring plate coupled by a pair of the plate frames.
Figure 11:
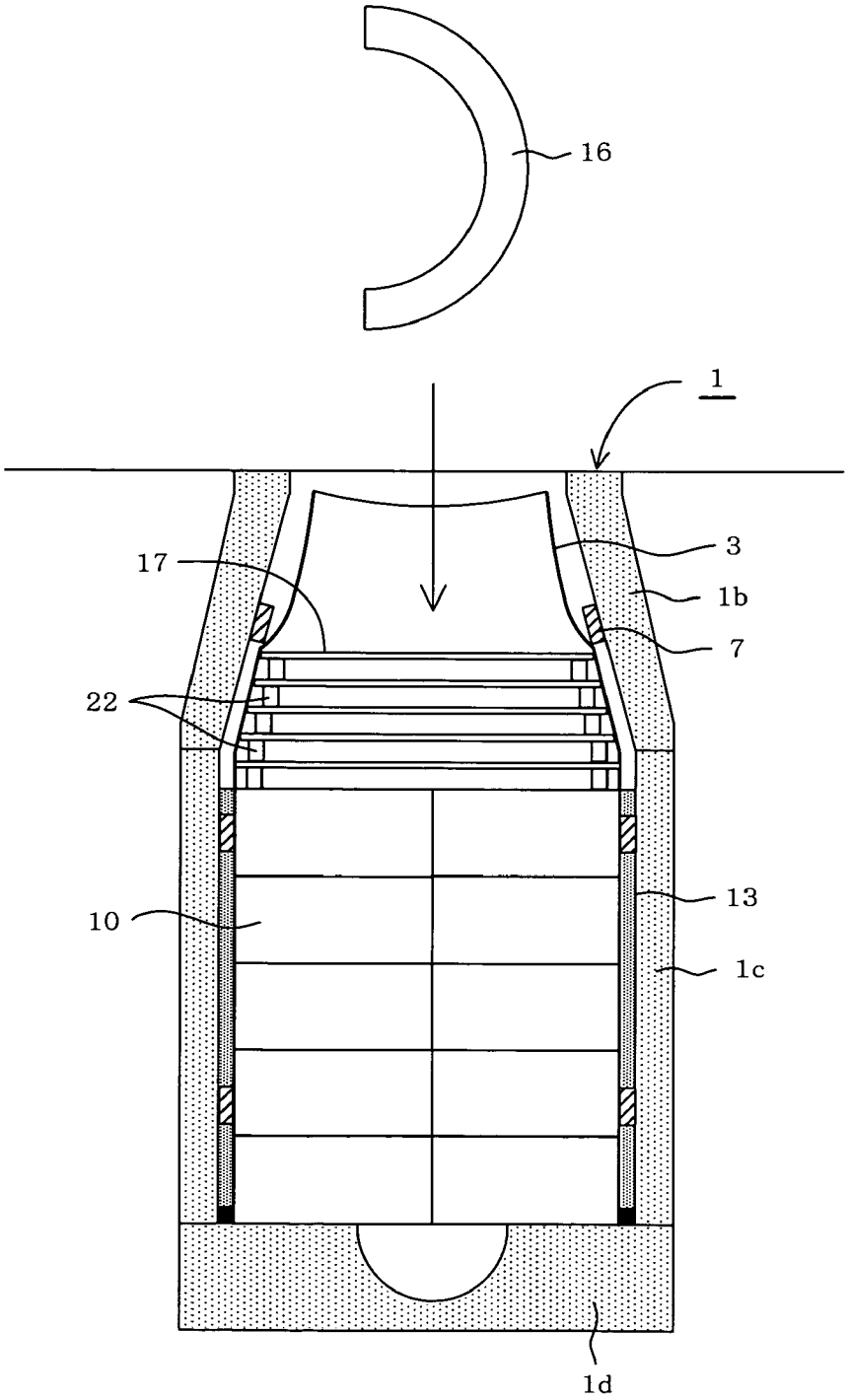
FIG. 11 is a cross-sectional view for showing a condition that plate frames for the inclined wall are being coupled.
Figure 12:
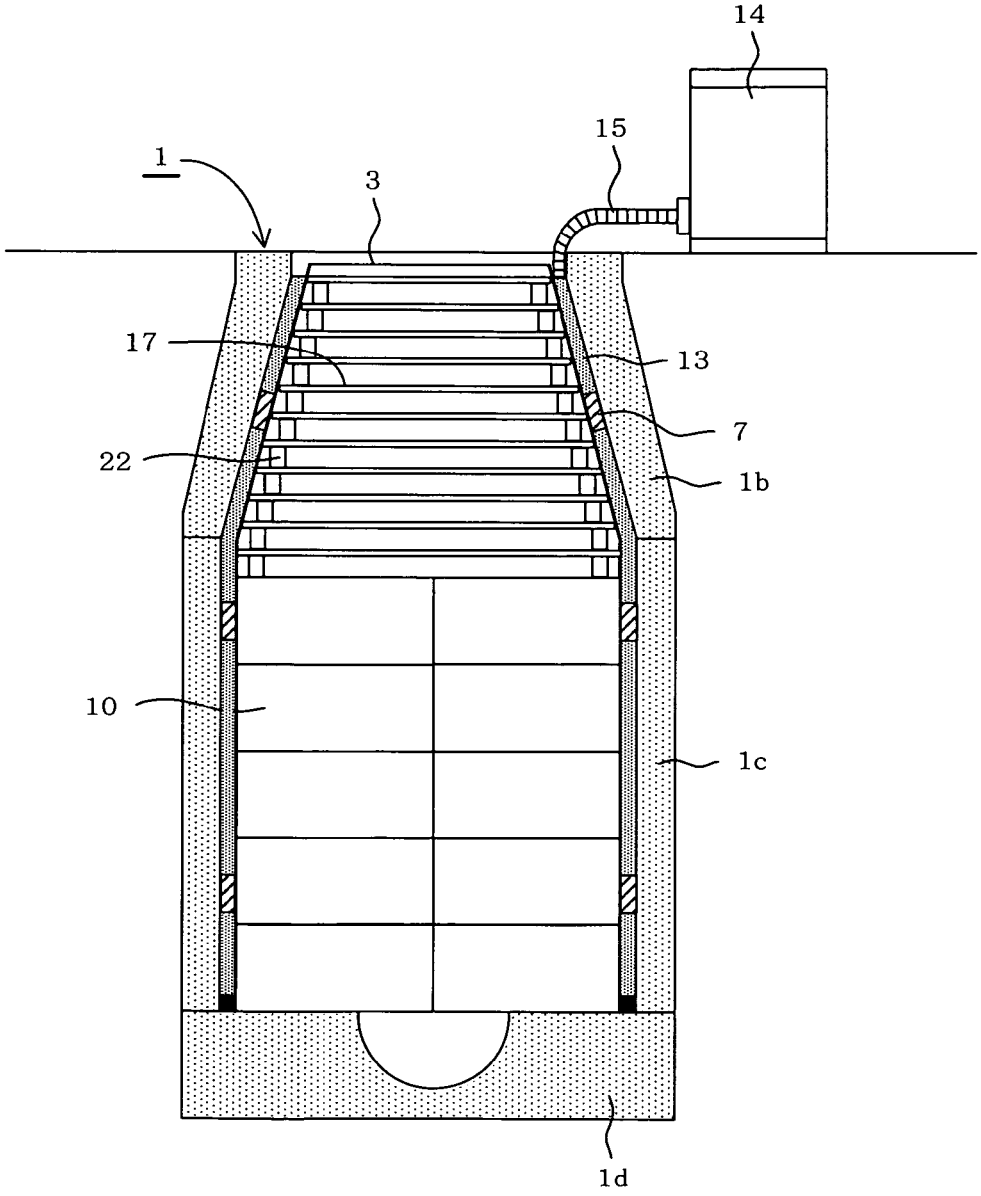
FIG. 12 is a cross-sectional view for showing a condition that a filler is being poured after coupling the plate frames for the inclined wall.

Next, segment-shaped plate frames 16 as illustrated in FIG. 3 are used to provide a frame assembly corresponding to the inclined wall 1*b* of the manhole, as shown in FIGS. 11 and 12. The plate frame 16 is formed as a plain plate having a predetermined width and curved in the shape of an arc of semi-circumference, as shown on the left side of FIG. 3. The plate frame 16 can be formed, for example, of a plate material, such as cone panel, and the like. The same two plate frames are coupled to each other by coupling plates 18, as shown on the right side of FIG. 3, thereby providing a circular ring plate 17.

Figure 4:
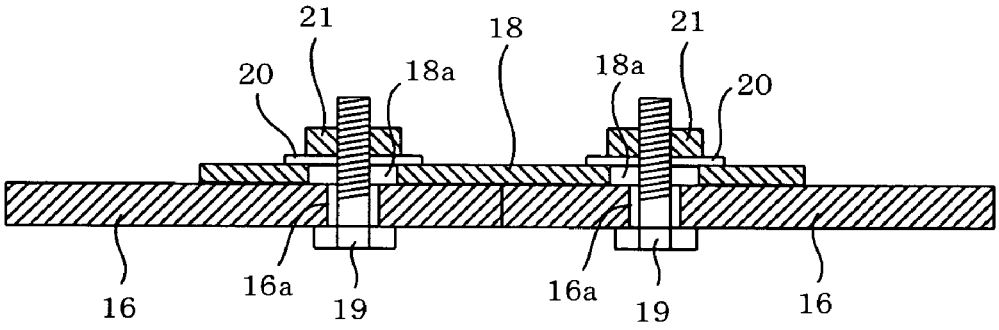
FIG. 4 is a cross-sectional view for showing how plate frames are coupled to each other.

FIG. 4 shows how the two plate frames 16 are coupled to each other. As shown in FIG. 4, holes 16*a* are formed in respective end portions of the plate frames 16. On the other hand, two holes 18*a* are formed in the coupling plates 18, respectively. Two bolts 19 are inserted from the lower side through the holes 16*a* and 18*a*, respectively and screwed into nuts 21 via washers 20. This allows the two plate frames 16 to be coupled via the coupling plate 18.

In order to provide the frame assembly corresponding to the inclined wall 1*b* of the manhole 1, two plate frames 16 having the same diameters are prepared as one pair, and also a plurality of the pairs thereof having diameters different from each other are prepared. In the example illustrated in FIG. 12, eleven pairs of the plate frames 16 are prepared. The plate frames 16 are different in outer diameter from each other. The ring plate of the lowermost plate frames has a maximum diameter, corresponding to that of the short frame pipe 10 for the straight wall 1*c* of the manhole 1, and the ring plate of the uppermost plate frames has a minimum diameter. The diameters of a plurality of the ring plates 17 are determined to be gradually (one by one) different from each other by a certain amount (for example, about several centimeters).

A plurality of the pairs of the plate frames 16 are inserted into the bag of the rehabilitating sheet 3, and the inserted each pair of the plate frames 16 is coupled to each other to form the ring plate 17 within the bag of the rehabilitating sheet 3. The ring plates 17 thus coupled are stacked one by one via spacers 22 from the maximum to the minimum, as shown in FIGS. 11 and 12, thereby providing a frame assembly corresponding to the inclined wall 1*b* of the manhole 1. FIG. 13 also shows the stacking of the ring plates 17 as a perspective view.

In order to adjust a space between the adjacent ring plates 17, it is preferable that height of each spacer 22 can be variably adjusted. Alternatively, the spaces 22 can be combined with the other spacers. Namely, it is possible to use not only one spacer 22 having a certain height but also the other thin spacers for adjusting the total height of combined spacers.

The outer circumferential shape of the assembly of the plate frames 17 corresponds to the shape of the inclined wall 1*b* of the manhole 1. Furthermore, the outer circumferential surface of each ring plate 17 presses the inner surface of the rehabilitating sheet 3, thereby expanding the rehabilitating sheet 3 in the form of a lantern. Consequently, the rehabilitating sheet 3 can be supported in the form of the hollow circular truncated cone.

Next, the filler 13 is inserted again, as shown in FIG. 12. Namely, a gap between the rehabilitating sheet 3 supported by the frame assembly and the inner circumferential surface of the inclined wall 1*b* is filled with the filler 13, which is poured from the container 14 via the hose 15. A hand-carry type filler container having a beak (not shown) may be used to fill the gap between the upper portion of the inclined wall 1*b* and the upper portion of the rehabilitating sheet 3 with the filler 13.

After the filler 13 has been poured, the filler 13 is hardened. The rehabilitating sheet 3 is integrated via the hardened filler 13 with the side walls 1*b*, 1*c* of the manhole 1. This provides a strong lining consisting of the rehabilitating sheet 3 and the filler 13 for the inner circumferential surface of the side walls 1*b*, 1*c* of the manhole 1.

After the filler 13 has been hardened, the frame assemblies are disassembled and removed from the manhole 1. Thereafter, a gap between a lower side edge of the rehabilitating sheet 3 and a circumferential edge of the bottom portion 1*d* as well as a circumferential edge of an upper half portion of the circular opening of the pipe 2 is sealed using a sealing material 24 such as an epoxy resin, and the like, as shown in FIG. 14. Prior to the sealing, a part of the rehabilitating sheet 3 covering the upper half portion of the circular opening of the pipe 2 must be cut and removed. In addition, a gap between a circumferential edge of the upper end of the rehabilitating sheet 3 and a circumferential edge of the opening 1*a* is sealed using a sealing material 23. Thus, the construction for rehabilitating the manhole 1 has been completed.

The inner circumferential surface of the side walls 1*b*, 1*c* can be reinforced by the lining performed in the construction for rehabilitating the manhole 1. Further, since a surface (inner circumferential surface) of the rehabilitating sheet 3 is resistant to water and/or corrosion, the side walls 1*b*, 1*c* can be prevented from being invaded with water and moisture and from being corroded.

In the method for rehabilitating a manhole according to the first embodiment, large-scaled and expensive instruments are not required. The manhole can therefore be rehabilitated readily and at low cost. Further, since a large area is not occupied in the construction site, there are no serious influences on the traffic.

In addition, the rehabilitating sheet 3 in this embodiment can be formed at a low cost by readily processing a cheap sheet material. The cost for the rehabilitating sheet 3 is lower than that of segments for the rehabilitating pipe in the method disclosed in Japanese Patent Laid Open Publication No. 2005-307577. Moreover, after completion of the lining, the components such as block frames 9, the plate frames 16, and the like can be disassembled and removed from the manhole. Thereafter, those components can be used repeatedly in another construction of rehabilitating a manhole. The cost can thereby be further reduced. Furthermore, the plate frame 16 can be fabricated at a low cost by readily processing a cheap plate material, such as a cone panel, and the like. From these points of view, the construction for rehabilitating a manhole can be implemented at a low cost.

The plate frame 16 has a shape curved like an arc of semi-circumference, and two plate frames 16 as one pair are coupled to each other to provide the ring plate 17 in this embodiment. Alternatively, three plate frames each curved like an arc of one-third of circumference may be coupled to each other to provide the ring plate 17, or four plate frames each curved like an arc of one-fourth of circumference may be coupled to each other to provide the ring plate 17. Namely, more than three plate frames may be coupled to each other to provide the ring plate 17. In the above-mentioned embodiment, the two plate frames 9 as one pair are coupled to each other to provide the short frame pipe 10. However, more than three plate frames may be coupled to each other to provide the short frame pipe 10.

Figure 18:
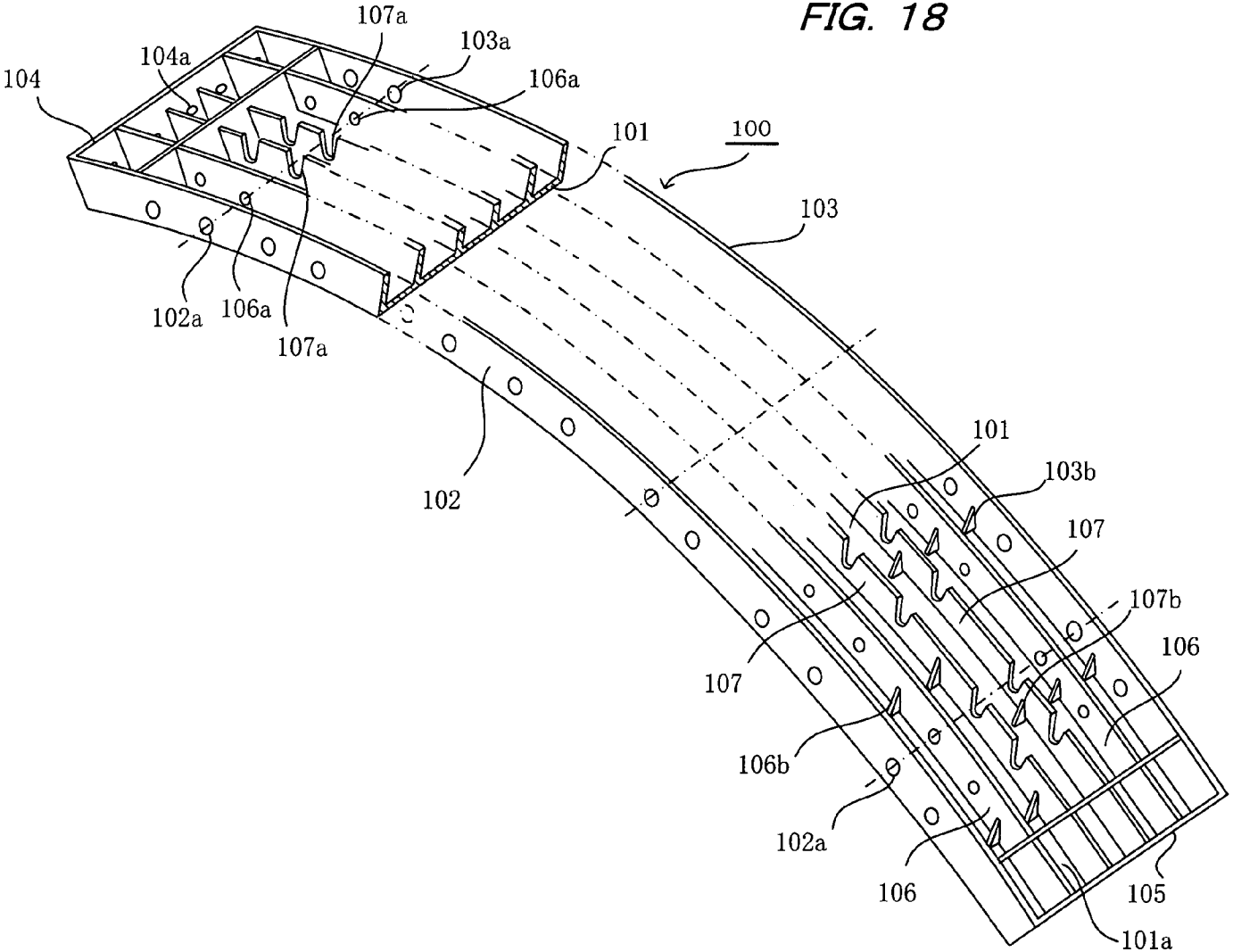
FIG. 18 is a perspective view for showing a structure of a segment as an assembling unit for the rehabilitating pipe.
Figure 19:
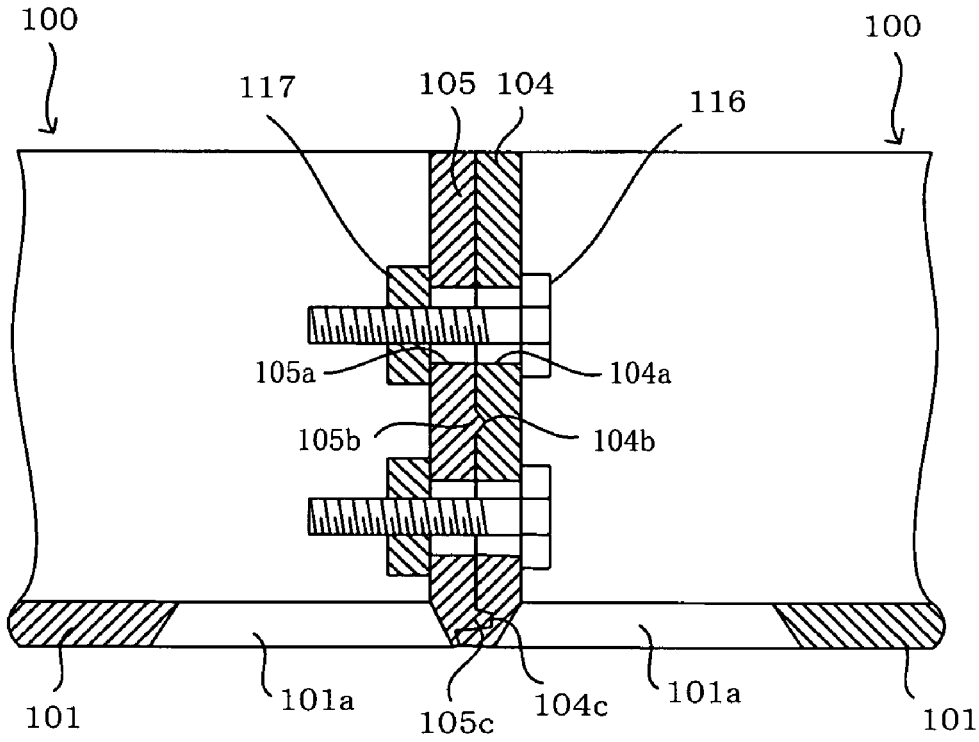
FIG. 19 is a cross-sectional view for showing how the segments are coupled in the circumferential direction.

Next, referring to FIGS. 15, 16, 18 through 21, description proceeds to a method for rehabilitating a manhole according to a second embodiment of the present invention. In the first embodiment, the inner circumferential entire surface of the side walls 1*b*, 1*c* of the manhole 1 was lined by the rehabilitating sheet 3. In the second embodiment, the inner circumferential surface of the inclined wall 1*b* of the manhole 1 is lined by a rehabilitating sheet 3A while the inner circumferential surface of the straight wall 1*c* thereof is lined by a rehabilitating pipe 200 assembled by coupling a plurality of segments 100, as shown in FIG. 18.

FIG. 18 shows the segment 100 as an assembling unit for the rehabilitating pipe 200. A plurality of the segments 100 is coupled in both the circumferential direction and the vertical direction (pipe longitudinal direction) to assemble the rehabilitating pipe 200.

At first, description is made about a structure of the segment 100. As shown in FIG. 18, the segment 100 comprises an internal surface plate 101, side plates 102, 103, end plates 104, 105, and respectively two each of reinforcing plates 106, 107. These plates 101 through 107 of the segment 100 are integrally molded from a transparent, semitransparent, or opaque plastic. The internal surface plate 101 is formed as a plate having a predetermined width and is arcuately curved at a predetermined angle, for example, 72 degrees, that divides the circumference into a plurality of equal parts (five parts). A plurality of rectangular openings 101*a* is formed respectively on each of both end parts of the internal surface plate 101 for performing from the inside the work in order to mutually couple the segments 100 in the circumferential direction.

The side plates 102, 103 are provided upright at a predetermined height on both side edges of the internal surface plate 101. A plurality of through holes 102*a*, 103*a* is formed in each of the side plates 102, 103 at a predetermined interval in the circumferential direction for passing therethrough coupling members in the pipe longitudinal direction.

The end plates 104, 105 are provided upright at both end edges of the internal surface plate 101 at the same height as each of the side plates 102, 103. Through holes 104*a*, 105*a* are provided at a plurality of locations in the end plates 104, 105 for passing therethrough bolts that mutually couple the segments 100 in the circumferential direction.

The reinforcing plates 106, 107 reinforce the mechanical strength of the entire segment 100, and are provided upright at a predetermined height on the top surface of the internal surface plate 101 on the inner sides of the side plates 102, 103. In the reinforcing plates 106, 107 are formed a plurality of through holes 106*a* and notched parts 107*a* for inserting therethrough the coupling members 111 (See FIG. 21) in the pipe longitudinal direction at a position corresponding respectively to the through holes 102*a*, 103*a* of the side plates 102, 103.

In addition, laterally projecting, small, right triangular protruding plates 103*b*, 106*b*, 107*b* (the protruding plates of the side plate 102 are not shown) are formed at a plurality of locations on the inside surfaces of the side plates 102, 103 and both side surfaces of the reinforcing plates 106, 107 to prevent deformation respectively thereof, thereby forming a rib structure that enhances the strength of the segment 100.

Next, description is made as regards a method of coupling the segments 100 in the circumferential direction. As shown in detail in FIG. 19, the segments 100 are mutually coupled in the circumferential direction. Namely, at first, the outer surfaces of the end plates 104 and 105 of all segments 100 are sealed. Bolts 116 are then inserted into the through holes 104*a*, 105*a* from the opening 101*a* of the internal surface plate 101, thereafter screwing on nuts 117 and tightening both end plates 104, 105. Furthermore, recessed parts 104*b*, 104*c* are formed across the entire length of the end plate 104 in the pipe longitudinal direction, and protruding parts 105*b*, 105*c*, which respectively interfit with those recessed parts 104*b*, 104*c*, are formed across the entire length of the end plate 105 in the pipe longitudinal direction, thereby facilitating the work of positioning and tightly sealing both segments 100 during coupling. By coating the interfitted part with a sealing material (not shown) beforehand, the watertightness of the coupled parts can be enhanced more.

When the coupling of the segments 100 in the circumferential direction is complete, a cover (not shown) tightly seals each opening 101*a*. At this time, the inner circumferential surface of the cover is continuous with the inner circumferential surface of each internal surface plate 101, thus forming a uniform inner circumferential surface.

Figure 20:
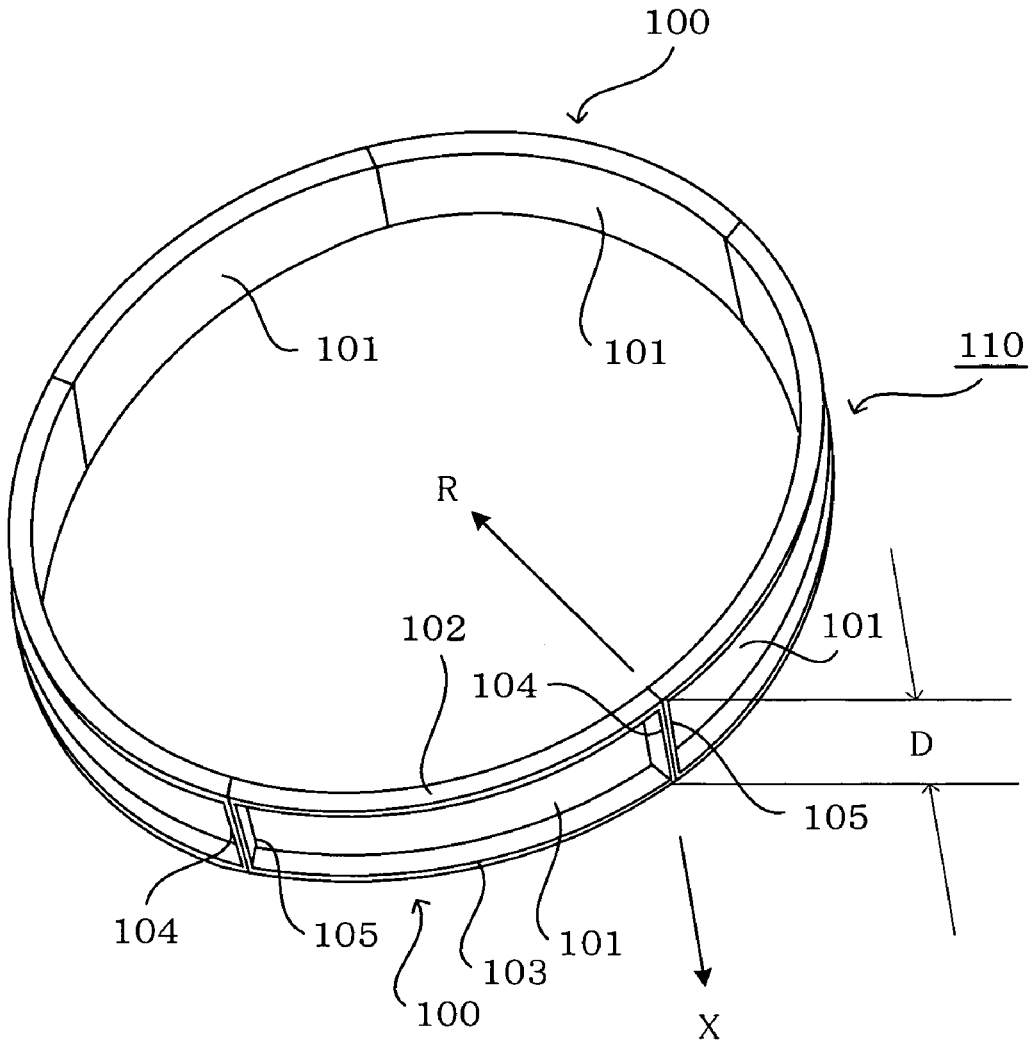
FIG. 20 is a perspective view for schematically showing a pipe unit constituted by a plurality of the segments coupled in the circumferential direction.

After the segments 100 are successively coupled in the circumferential direction, the circumferentially coupled segments 100 form a ring shaped pipe unit 110 as shown in FIG. 20. The ring shaped pipe unit 110 is obtained, when a circular pipe is cut off along the radial direction R to have a predetermined length D. An outer diameter of the ring shaped pipe unit 110 is slightly smaller than an inner diameter of the straight wall 1*c* of the manhole 1 to be repaired. The segment 100 corresponds to a block member obtained when the ring shaped pipe unit 110 is segmented in the circumferential direction in equal parts (five parts in the illustrated example).

A plurality of the ring shaped pipe units 110 is successively coupled and stacked in the vertical direction (pipe longitudinal direction) X to be mutually coupled in the vertical direction (pipe longitudinal direction). Namely, the segments 100 are also successively coupled in the pipe longitudinal direction. Such coupling of the segments 100 in the pipe longitudinal direction is repeated until the rehabilitating pipe 200 having a desired length is laid inside the manhole 1.

Figure 21:
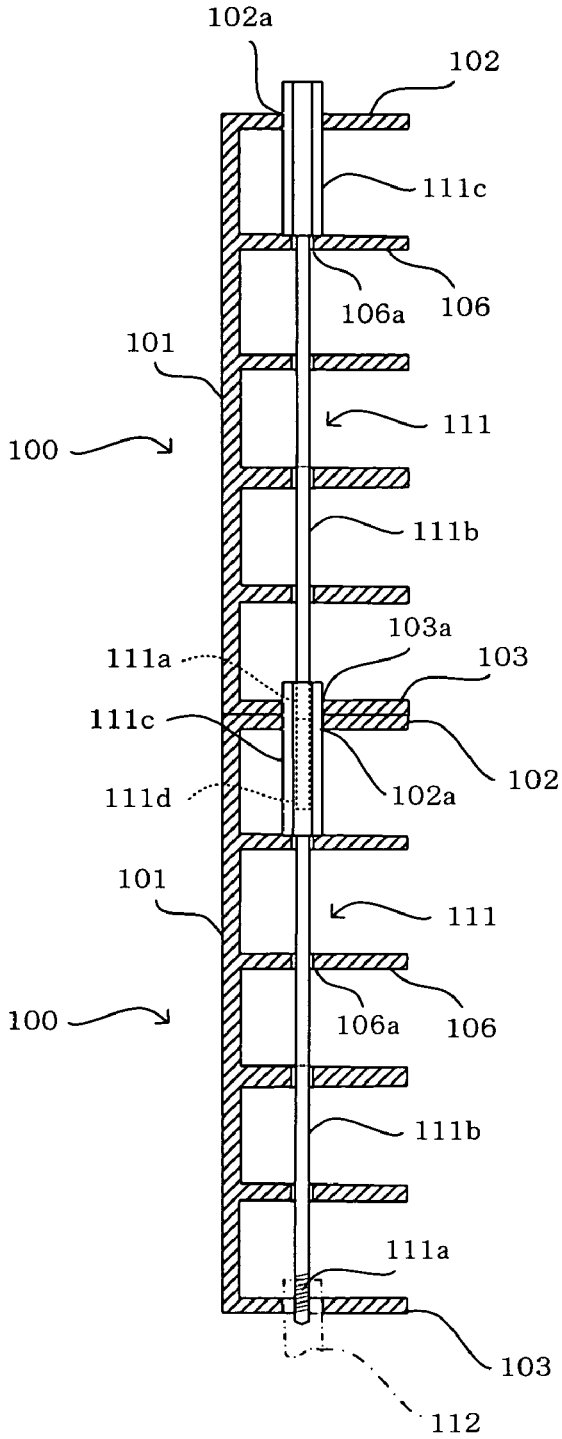
FIG. 21 is a cross-sectional view for showing how the segments are coupled in the vertical direction.

The coupling of the segments 100 in the pipe longitudinal direction is performed using a coupling member 111 made of a metal that integrally joins a rod 111*b* with both end parts, one end part comprising a screw part 111*a*, and the other end part comprising a nut part 111*c* wherein a screw hole 111*d* is formed into which the screw part 111*a* is screwed, as shown in FIG. 21.

In FIG. 21, the coupling member 111 on the lower side is already joined to the nut part 112 of another coupling member, as shown by the chain line, and fixed to another segment (not shown). In this state, to couple the segment 100 on the upper side to the segment 100 on the lower side in the vertical direction, the outer surfaces of the side plates 102 and 103 of both segments 100 are tightly sealed and the nut part 111*c* protruding from the side plate 102 of the segment 100 is interfitted with a through hole 103*a* of the side plate 103 of the segment 100. Subsequently, the coupling member 111 is inserted to pass through a through hole 102*a* of the side plate 102 of the segment 100, and a screw part 111*a* thereof is screwed into the screw hole 111*d* of the nut part 111*c* of the coupling member 111. When a nut part 111*c* of the coupling member 111 is screwed in and it makes contact with a reinforcing plate 106 of the segment 100, the coupling member 111 clamps the segment 100 against the segment 100, thereby coupling both the segments 100 in the upper and lower sides. The coupling of each segment is performed using, for example, four coupling members per segment, and both the segments 100 are coupled rigidly in the pipe longitudinal direction.

When the segment 100 of the lower side in FIG. 21 is the initial segment in the pipe longitudinal direction, as shown in the chain line, a fixing member (112) having the same structure as the nut part 111*c* that can be fixed to the screw part 111*a* of the coupling member 111 by some means is used as the coupling member and is provided in the side plate 103 of the segment 100 of the lower side.

Figure 15:
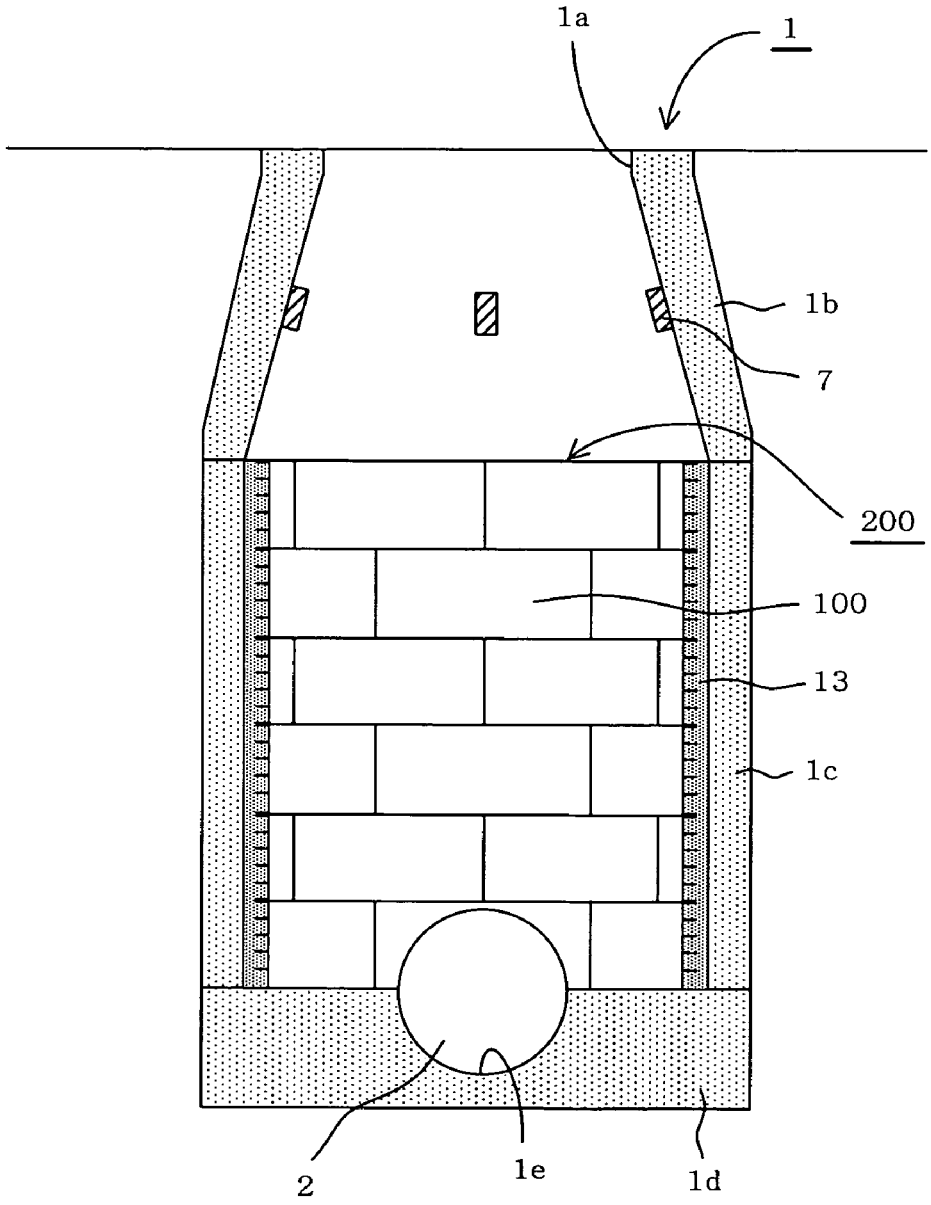
FIG. 15 is a cross-sectional view for showing a condition that a filler is poured after assembling the rehabilitating pipe inside the straight wall of the manhole in a process of a construction for rehabilitating the manhole according to a second embodiment of the present invention.

Thus, the side plates 102 and 103 of both segments 100 of the upper and lower ring shaped pipe units 110 are sealed successively, both the segments 100 are successively coupled in the vertical direction in order that an inner surface of each internal surface plate 101 may form uniform inner surfaces, thereby assembling the rehabilitating pipe 200 having the uniform inner surfaces as an inner circumferential surface thereof, as shown in FIG. 15.

Figure 16:
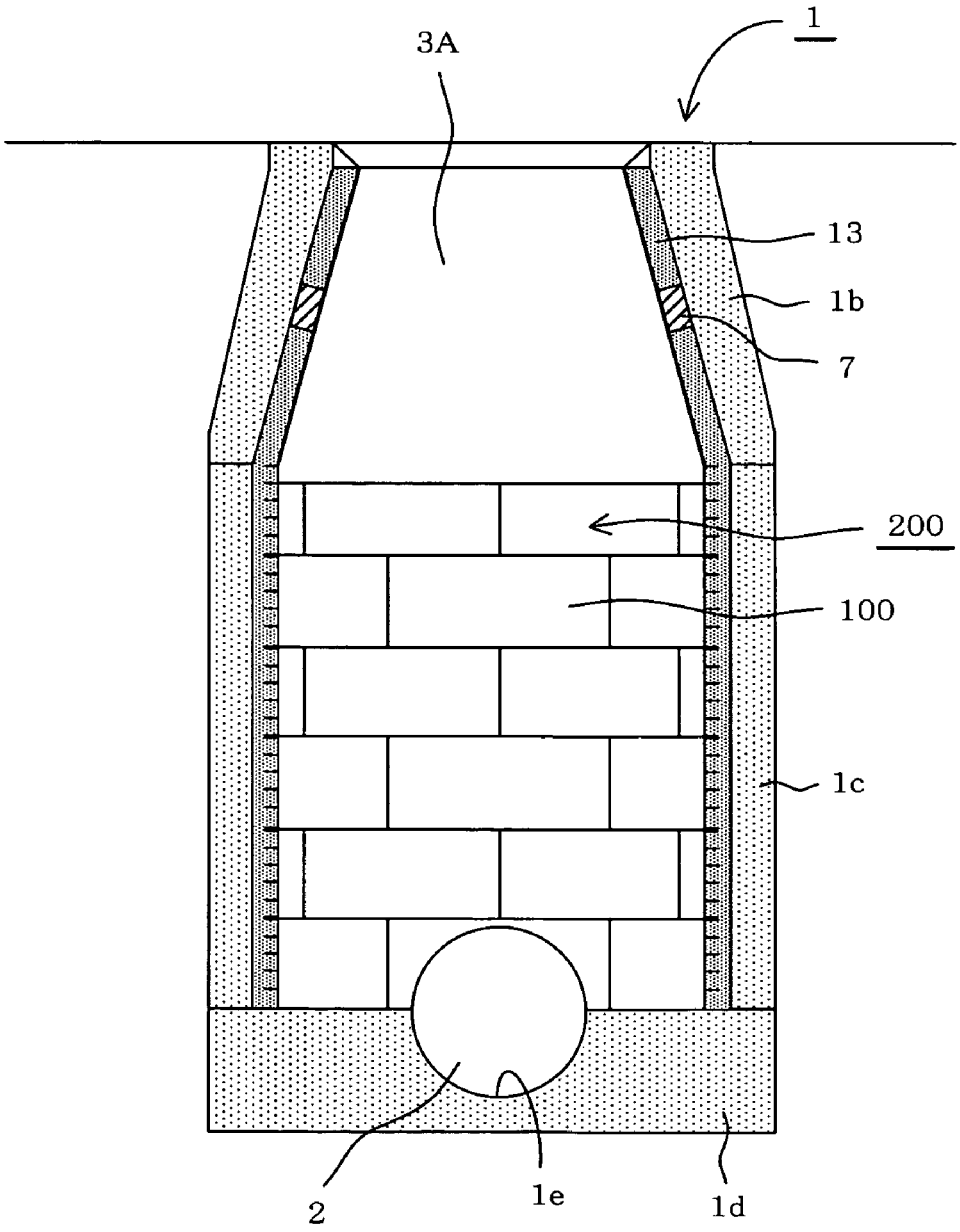
FIG. 16 is a cross-sectional view for showing a condition that the construction for rehabilitating the manhole according to the second embodiment has been completed.

For the coupling of the upper and lower segments 100 in the pipe longitudinal direction, there is a method that aligns each end plate of each segment, and there is also a method that offsets each end plate of each segment. In the former method, the segment to be coupled is positioned so that its end plate is aligned with the end plate of a previously coupled segment. In the latter method, the segment to be coupled is positioned so that its end plate is offset with respect to the end plate of a previously coupled segment, as shown in FIGS. 15 and 16. Namely, if offsetting as in the latter case, the end plates of all segments form lines aligned every other segment in the pipe longitudinal direction.

Prior to assembling the rehabilitating pipe 200, spacers (not shown) are fixed at a plurality of locations of the inner circumferential surface of the straight wall 1*c* in order to provide between the outer circumferential surface of the rehabilitating pipe 200 and the inner circumferential surface of the straight wall 1*c* a gap that will be later filled with the filler 13.

Further, spacers 7 are fixed at a plurality of locations of the inner circumferential surface of the inclined wall 1*b* in order to provide between a rehabilitating sheet 3A described later (See FIG. 16) and the inner circumferential surface of the inclined wall 1*b* a gap that will be later filled with the filler 13

The gap between the outer circumferential surface of the rehabilitating pipe 200 and the inner circumferential surface of the straight wall 1*c* is filled with the filler 13, as shown in FIG. 15. When the poured filler 13 has been hardened, the rehabilitating pipe 200 is made integral with the straight wall 1*c* by the filler 13, and the inner circumferential surface of the straight wall 1*c* is lined by the rehabilitating pipe 200.

Although not shown, supporting frames are assembled in the rehabilitating pipe 200 to support a plate frame for the rehabilitating sheet 3A. The frame assembly described with reference to FIGS. 9 and 10 in the first embodiment can be used as the supporting frames in this embodiment.

Next, the rehabilitating sheet 3A shown in FIG. 16 is inserted into the inclined wall 1*b* of the manhole 1. The rehabilitating sheet 3A is a sheet that is similar in shape and in material to the sheet 3*a* shown in upper half portion of FIG. 1 in the first embodiment.

Although not shown in FIG. 16, the plate frames described with reference to FIG. 3 in the first embodiment are used to expand the rehabilitating sheet 3A against the spacers 7 so that the rehabilitating sheet 3A may be in the form of the hollow circular truncated cone. In this case, the lower end portion of the rehabilitating sheet 3A is adhesively fixed to the inner circumferential surface of an upper end portion of the rehabilitating pipe 200.

Next, the gap between the rehabilitating sheet 3A and the inner circumferential surface of the inclined wall 1*b* is filled with the filler 13, as shown in FIG. 16. When the filler 13 has been hardened, the rehabilitating sheet 3A and the inclined wall 1*b* have been made integral by the filler 13. Consequently, the inner circumferential surface of the inclined wall 1*b* is lined by the rehabilitating sheet 3A. After the lining is completed, the plate frames and the supporting frames are removed from the manhole 1.

In the second embodiment, the lining of the inner circumferential surface of the straight wall 1*c* is performed more strongly than that in the first embodiment.

Figure 17:
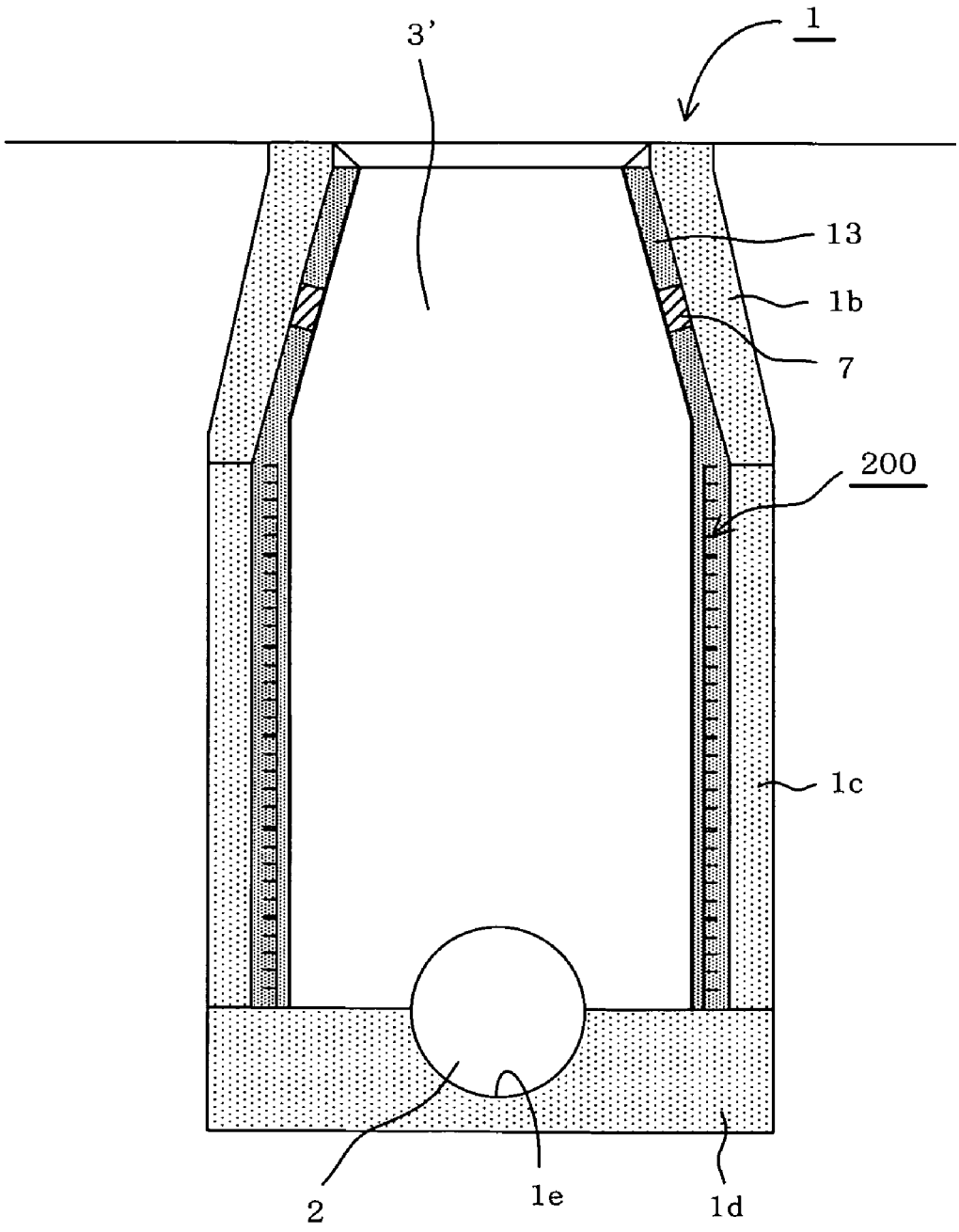
FIG. 17 is a cross-sectional view for showing a condition that a construction for rehabilitating the manhole according to a third embodiment has been completed.

Next, referring to FIG. 17, description proceeds to a method for rehabilitating a manhole according to a third embodiment of the present invention. In the second embodiment, only the inner circumferential surface of the inclined wall 1*b* of the manhole 1 was lined by the rehabilitating sheet 3A. In the third embodiment, not only the inner circumferential surface of the inclined wall 1*b* but also the inner circumferential surface of the rehabilitating pipe 200 inside the straight wall 1*c* are lined by a rehabilitating sheet 3', as shown in FIG. 17. In other words, the lining of the straight wall 1*c* of the manhole 1 is doubled by the rehabilitating pipe 200 and the rehabilitating sheet 3'.

In the processes of this embodiment, at first, the rehabilitating pipe 200 is assembled similarly to that of the second embodiment, as shown in FIG. 15. Further, a gap between the outer circumferential surface of the rehabilitating pipe 200 and the inner circumferential surface of the straight wall 1*c* is filled with the filler 13, also similarly to that of the second embodiment. When the filler 13 has been hardened, the inner circumferential surface of the straight wall 1*c* becomes integral with the rehabilitating pipe 200 and is lined thereby.

Next, the rehabilitating sheet 3' shown in FIG. 17 is inserted into the manhole 1. The rehabilitating sheet 3' is a sheet that is similar in size and in material to the rehabilitating sheet 3 shown in FIG. 2 in the first embodiment. After inserting the rehabilitating sheet 3' into the manhole 1, block frames similar to those as shown in FIG. 5 are used to support the lower portion of the rehabilitating sheet 3' and expand it toward the inner circumferential surface of the rehabilitating pipe 200, as is described with reference to FIGS. 9 and 10.

Next, the gap between the inner circumferential surface of the rehabilitating pipe 200 and the lower portion of the rehabilitating sheet 3' is filled with the filler 13. When the filler 13 has been hardened, the lower portion of the rehabilitating sheet 3' is made integral with the rehabilitating pipe 200, and the inner circumferential surface of the rehabilitating pipe 200 is also lined by the rehabilitating sheet 3'.

Thereafter, plate frames the same as or similar to the plate frames 16 in FIG. 3 are used to support the upper portion of the rehabilitating sheet 3' and expand it so as to have a shape of the inner circumferential surface of the inclined wall 1*b*, as is described with reference to FIGS. 11 through 13.

Next, the gap between the upper portion of the rehabilitating sheet 3' and the inner circumferential surface of the inclined wall 1*b* is filled with the filler 13, as shown in FIG. 17. When the filler 13 has been hardened, the upper portion of the rehabilitating sheet 3' and the inclined wall 1*b* have been made integral by the filler 13. Consequently, the inner circumferential surface of the inclined wall 1*b* is lined by the upper portion of the rehabilitating sheet 3'. After the lining is completed, the block and plate frames are removed from the manhole 1.

In the third embodiment, the lining of the inner circumferential surface of the straight wall 1*c* of the manhole 1 is doubled by the rehabilitating pipe 200 and the rehabilitating sheet 3'. Consequently, the lining of the straight wall 1*c* is performed more strongly than that in the second embodiment.

What is claimed is:

1. A method for rehabilitating a manhole which rehabilitates the manhole by lining side walls thereof having a side wall of a hollow circular truncated cone form and a side wall of a hollow column form, said method comprising the steps of:

preparing a rehabilitating sheet which has a shape corresponding to a shape of the whole inner circumferential surface of said side walls of a manhole to be rehabilitated;

providing a frame assembly which supports said rehabilitating sheet so as to have a shape corresponding to the shape of the inner circumferential surface of said side walls of said manhole after inserting said rehabilitating sheet into said manhole; and filling a gap between said inner circumferential surface of said side walls of said manhole and said rehabilitating sheet with a filler to line the inner circumferential surface of said side walls of said manhole by the rehabilitating sheet;

wherein ring plates having respective diameters different from each other and corresponding to respective portions of the side wall of the hollow circular truncated cone form are prepared, and the ring plates of a smaller diameter are successively stacked in the vertical direction on the ring plates of a larger diameter, thereby supporting said rehabilitating sheet so as to have a shape corresponding to the shape of the inner circumferential surface of the side wall of the hollow circular truncated cone form.

2. A method as claimed in claim 1, wherein said ring plates having diameters different from each other are stacked via spacers respectively interposed therebetween.

3. A method as claimed in claim 1, wherein said ring plate comprises a plurality of plate frames coupled to each other.

4. A method as claimed in claim 1, wherein short frame pipes having the same diameters are prepared and successively stacked to support said rehabilitating sheet so as to have a shape corresponding to the shape of an inner circumferential surface of said side wall of the hollow column form of said manhole.

5. A method as claimed in claim 4, wherein said short frame pipe comprises a plurality of block frames coupled to each other.

6. A method as claimed in claim 1, wherein said rehabilitating sheet is made of a sheet material resistant to water and/or corrosion.

7. A method as claimed in claim 6, wherein said sheet material is made of high density polyethylene.

8. A method as claimed in claim 1, wherein said step of filling a filler is performed dividedly into a plurality of times including a time during assembly of the frames and a time after completion of the frame assembly, and a filler capable of being quickly hardened is used when the lower end frames have been installed.

9. A method as claimed in claim 1, wherein said frame assembly is disassembled and removed after the lining by said rehabilitating sheet has been completed.

10. A method for rehabilitating a manhole which rehabilitates the manhole by lining side walls thereof having a side wall of a hollow circular truncated cone form and an underlying side wall of a hollow column form, said method comprising the steps of:

preparing a rehabilitating sheet which has a shape corresponding to a shape of the inner circumferential surface of said side wall of said hollow circular truncated cone form of a manhole to be rehabilitated;

successively coupling a plurality of segments inside the underlying side wall of said hollow column form of said manhole, thereby assembling a rehabilitating pipe having a hollow column form whose outer diameter is smaller than an inner diameter of said underlying side wall of said hollow column form of said manhole and whose inner circumferential surface is constituted by the successively coupled segments;

filling a gap between said inner circumferential surface of said underlying side wall of said hollow column form of said manhole and said rehabilitating pipe with a filler to line the inner circumferential surface of said underlying side wall of said hollow column form of said manhole by the rehabilitating pipe;

inserting said rehabilitating sheet into said manhole and adhering a lower end portion of said rehabilitating sheet on an inner circumferential surface of an upper end portion of said rehabilitating pipe, thereafter providing a frame assembly which supports said rehabilitating sheet so as to have a shape corresponding to the shape of an inner circumferential surface of said side wall of the hollow circular truncated cone form; and filling a gap between said inner circumferential surface of said side wall of the hollow circular truncated cone form of said manhole and said rehabilitating sheet with a filler to line the inner circumferential surface of said side wall of the hollow circular truncated cone form of said manhole by the rehabilitating sheet;

wherein ring plates having respective diameters different from each other and corresponding to respective portions of the side wall of the hollow circular truncated cone form are prepared, and the ring plates of a smaller diameter are successively stacked in the vertical direction on the ring plates of a larger diameter, thereby supporting said rehabilitating sheet so as to have a shape corresponding to the shape of the inner circumferential surface of the side wall of the hollow circular truncated cone form.

11. A method for rehabilitating a manhole which rehabilitates the manhole by lining side walls thereof having a side wall of a hollow circular truncated cone form and a side wall of a hollow column form, said method comprising the steps of:

successively coupling a plurality of segments inside the side wall of said hollow column form of a manhole to be rehabilitated, thereby assembling a rehabilitating pipe having a hollow column form whose outer diameter is smaller than an inner diameter of said side wall of said hollow column form of said manhole and whose inner circumferential surface is constituted by the successively coupled segments;

filling a gap between said inner circumferential surface of said side wall of said hollow column form of said manhole and said rehabilitating pipe with a filler to line the inner circumferential surface of said side wall of said hollow column form of said manhole by the rehabilitating pipe;

preparing a rehabilitating sheet which has a shape corresponding not only to a shape of the inner circumferential surface of said side wall of said hollow circular truncated cone form of said manhole but also to a shape of the inner circumferential surface of said rehabilitating pipe;

inserting said rehabilitating sheet into said manhole, thereafter providing a frame assembly which supports said rehabilitating sheet so as to have a shape corresponding not only to the shape of the inner circumferential surface of said side wall of said hollow circular truncated cone form of said manhole but also to the shape of the inner circumferential surface of said rehabilitating pipe; and filling a gap between said inner circumferential surface of said side wall of the hollow circular truncated cone form of said manhole as well as the inner circumferential surface of said rehabilitating pipe and said rehabilitating sheet with a filler to line the inner circumferential surface of said side wall of the hollow circular truncated cone form of said manhole and the inner circumferential surface of said rehabilitating pipe by the rehabilitating sheet;

wherein ring plates having respective diameters different from each other and corresponding to respective portions of the side wall of the hollow circular truncated cone form are prepared, and the ring plates of a smaller diameter are successively stacked in the vertical direction on the ring plates of a larger diameter, thereby supporting said rehabilitating sheet so as to have a shape corresponding to the shape of the inner circumferential surface of the side wall of the hollow circular truncated cone form.

* * * * *